United States Patent [19]

Irie

[11] Patent Number: 4,878,660

[45] Date of Patent: Nov. 7, 1989

[54] SORTER

[75] Inventor: Yoichiro Irie, Suita, Japan

[73] Assignee: Mita Industrial Co., Ltd., Osaka, Japan

[21] Appl. No.: 222,781

[22] Filed: Jul. 22, 1988

[30] Foreign Application Priority Data

| | | | |
|---|---|---|---|
| Jul. 28, 1987 | [JP] | Japan | 62-186694 |
| Aug. 12, 1987 | [JP] | Japan | 62-199894 |
| Sep. 17, 1987 | [JP] | Japan | 62-231031 |

[51] Int. Cl.[4] ..... B65H 39/11

[52] U.S. Cl. ..... 271/293; 271/294

[58] Field of Search ..... 271/292, 293, 294

[56] References Cited

U.S. PATENT DOCUMENTS

| | | | |
|---|---|---|---|
| 4,580,775 | 4/1986 | Maruyama | 271/293 |
| 4,607,838 | 8/1986 | Matsuyama | 271/293 |

FOREIGN PATENT DOCUMENTS

| | | | |
|---|---|---|---|
| 212555 | 12/1983 | Japan | 271/293 |

*Primary Examiner*—Richard A. Schacher

[57] ABSTRACT

A sorter comprising a plurality of vertically arranged bin trays. The bin trays have widthwise projecting trunnions at least in one side thereof. The trunnions are stacked vertically and can move in the stacking direction along a predetermined moving passage. The sorter further comprises a transfer mechanism for elevating and lowering the trunnions successively one by one along the predetermined transfer passage and successively spacing adjacent bin trays vertically at their sheet receiving ends to form a sheet receiving opening. The transfer mechanism has a pair of cooperating rotating cam plates. Each of the rotating cam plates has at least one trunnion receiving groove extending radially and being opened at its radial outside end and an outer circumferential cam surface continuously extending circumferentially excepting the site of the trunnion receiving groove. The outer circumferential cam surface is a convoluted surface whose radius progressively increases in a predetermined rotating direction.

6 Claims, 16 Drawing Sheets

SORTER

FIELD OF THE INVENTION

This invention relates to a sorter for sorting and collecting sheets discharged from an electrostatic copying machine, a printer, or the like, and to a trunnion transfer mechanism.

DESCRIPTION OF THE PRIOR ART

Relatively small-sized "compact" sorters have been proposed and come into commercial acceptance. The prior art disclosing the compact sorters typically consists of, for example, U.S. Pat. Nos. 4,328,963, 4,332,377, 4,337,936, 4,343,463, 4,466,608, 4,466,609 and 4,478,406.

The compact sorter is provided with a plurality of vertically arranged bin trays. Each of the bin trays has a widthwise projecting trunnion at least on one side of its sheet-receiving end portion. The trunnions which may be pins having a circular cross section are stacked vertically and can move along a predetermined moving passage in the stacking direction. The sorter is further provided with a transfer mechanism for causing the trunnions to rise and descend along the moving passage successively one by one and moving the adjacent bin trays successively away from each other vertically at their sheet receiving ends to form a sheet receiving opening.

Generally, a transfer mechanism of the type called the Geneva rotating cam-type (disclosed, for example, in the above cited U.S. Pat. No. 4,328,968) and a transfer mechanism called the spiral rotating cam type (disclosed, for example, in U.S. Pat. No. 4,337,936) are used as the transfer mechanism in the above sorter. The Geneva rotating cam-type transfer mechanism is provided with a Geneva circular plate cam having formed therein at least one trunnion receiving groove extending radially and being open at its radial outside end, and the circular cam plate is adapted to rotate about a central axis extending in the width direction. The spiral rotating cam-type transfer mechanism is provided with a cylindrical cam having formed therein a trunnion receiving groove extending spirally at its outer circumferential surface, and the cylindrical cam is adapted to rotate about a vertically extending central axis.

The Geneva rotating cam-type transfer mechanism, however, has the disadvantage that when a given trunnion advances into and out of the trunnion receiving groove formed in the circular plate cam, collision and abrupt rising or descending occur (this will be described in detail later with reference to the accompanying drawings). Accordingly, relatively large noises are produced, and the transfer mechanism is not suitable for high-speed transfer of trunnions and has low durability.

On the other hand, the spiral rotating cam-type transfer mechanism can obviate the above problem of the Geneva rotating cam-type transfer mechanism because the spiral trunnion-receiving groove on the outer circumferential surface of the cylindrical cam can be in such a form as to ascend or descend gradually incident to rotation also at its lower and upper ends. It, however, has other problems to be described. Firstly, to make the cylindrical cam, the spirally extending trunnion receiving groove should be formed on the outside surface of a solid cylinder. The operation of forming the trunnion receiving groove is considerably difficult, and the cost of production is comparatively high. Secondly, it is usually desired to provide trunnions on both sides of each of a plurality of bin trays and transfer the trunnions synchronously on both sides of each bin tray. To meet this desire, it is necessary to provide the cylindrical cams on both sides of each bin tray and drivingly connect the two cylindrical cams. The two cylindrical cams are spaced from each other in the width direction and the rotating central axes of the two cylindrical cams extend vertically. Hence, to drivingly connect the two cylindrical cams, it is necessary to provide a plurality of rotating elements for converting rotation about a central axis extending in the width direction into rotation about a central axis extending vertically. This naturally leads to the necessity of providing a complex drivingly connecting mechanism and the cost of production becomes relatively high.

Conveniently, to avoid jamming of sheets during sheet collection, the downstream end portions of vertically adjoining bin trays are adapted to separate automatically in the vertical direction when their upstream end portions are spaced from each other vertically by the transfer mechanism. Thus, in the sorter disclosed in the above-cited U.S. Pat. No. 4,332,377, cam blocks of a predetermined shape are fixed to both sides of the downstream end portion of each of bin trays, and the downstream ends of the bin trays are stacked via the cam blocks. When the upstream end portion of an upper bin tray is elevated, its downstream end portion is moved in the downstream direction. Accordingly, cam blocks fixed to the upper bin tray slide in the downstream direction with respect to the cam blocks fixed to a lower bin tray. This causes the downstream end portion of the upper bin tray to ascend.

Since, however, in the above conventional sorter, the space between the downstream end portions of adjacent bin trays is totally dependent upon the sliding of two sets of cam blocks with respect to each other, the sorter cannot be free from defects inherent in the sliding of the blocks. Specifically, the sorter had low durability and produces unpleasant noises (frictional sounds). Moreover, the efficiency of motion conversion is low (in other words, the downstream end portions of adjacent bin trays cannot be spaced from each other sufficiently widely).

SUMMARY OF THE INVENTION

It is an object of this invention to provide a unique transfer mechanism which overcomes the above problem of the spiral rotating cam-type transfer mechanism and gives a solution to the above problem of the Geneva rotating cam-type transfer mechanism.

Another object of this invention is to provide a sorter equipped with the unique transfer mechanism.

Still another object of this invention is to provide a sorter provided with a unique cam means free from the above-mentioned defects which operates to space downstream end portions of adjacent bin trays from each other automatically according to the vertical distance between the upstream end portions of the bin trays.

According to one aspect of this invention, there is provided a transfer mechanism for a sorter, which comprises a plurality of vertically arranged bin trays, the bin trays respectively having a trunnion projecting in the width direction in at least one side thereof, the trunnions being stacked vertically and movable in the stacking direction along a predetermined moving passage. The transfer mechanism includes a pair of cooperating rotating cam plates and a rotating means. Each of the rotating cam plates has at least one trunnion receiving groove extending radially and being open at its radially outside end and an outer circumferential cam surface extending continuously in the circumferential direction excepting a site corresponding to the trunnion receiving groove, and the outer circumferential cam surface is a convoluted surface whose radius increases progressively in a given rotating direction. The pair of rotating cam plates are arranged such that their rotating central axes are positioned on both sides of the predetermined moving passage, a straight line connecting the rotating central axes crosses the predetermined moving passage obliquely, and that they move toward and away from each other in a predetermined rotating angular relation at a part at which the straight line connecting their rotating central axes crosses the predetermined moving passage. The rotating means rotates the pair of rotating cam plates synchronously in opposite directions to each other.

Preferably, the outer circumferential cam surface of each of the rotating cam plates is an Archimedian convoluted surface whose ratio of the rotating angle to the increase of the radius is constant. The trunnion desirably has a circular cross-sectional shape, and the different between the maximum radius and the minimum radius of the outer circumferential cam surface of each of the rotating cam plates corresponds to the diameter of the trunnion.

According to another aspect of this invention, there is provided a sorter comprising a plurality of bin trays arranged vertically and a transfer mechanism for properly elevating or lowering the upstream end portions of vertically adjoining bin trays so as to separate them from each other in the vertical direction, wherein the downstream end portions of the bin trays, which are moved downstream when their upper stream end portions are elevated and upstream when the upper stream end portions are lowered, are stacked via cam means for separating the downstream end portions of the adjoining bin trays according to the vertical spacing of their upper end portions. Each cam means comprises a pivot member disposed in a lower bin tray and an engaging protrusion disposed in an upper bin tray. The pivot member has an engagement portion capable of receiving the engaging protrusion from the upstream side, and is mounted so that it is free to pivot from a predetermined stop position in a predetermined direction in which the engagement portion is elevated. When the upstream end portion of an upper bin tray is elevated and its downstream end portion is moved downstream, the engaging protrusion is received in the engagement portion to permit the pivot member to rotate in the predetermined direction whereby the downstream end portion of the upper bin tray is elevated.

Preferably, the engagement portion of the pivot member has an open depressed portion at its upstream side, and guiding surface is provided upstream of the depressed portion. When the upstream end portions of the adjoining bin trays are not spaced vertically, the engaging protrusion is positioned on the guiding surface. The cam means are conveniently provided on both sides of the downstream end portions of the adjoining bin trays.

DETAILED DESCRIPTION OF THE PREFERRED EMBODIMENTS

With reference to the accompanying drawings, the preferred examples of the present invention will be described in detail.

Figure 1:
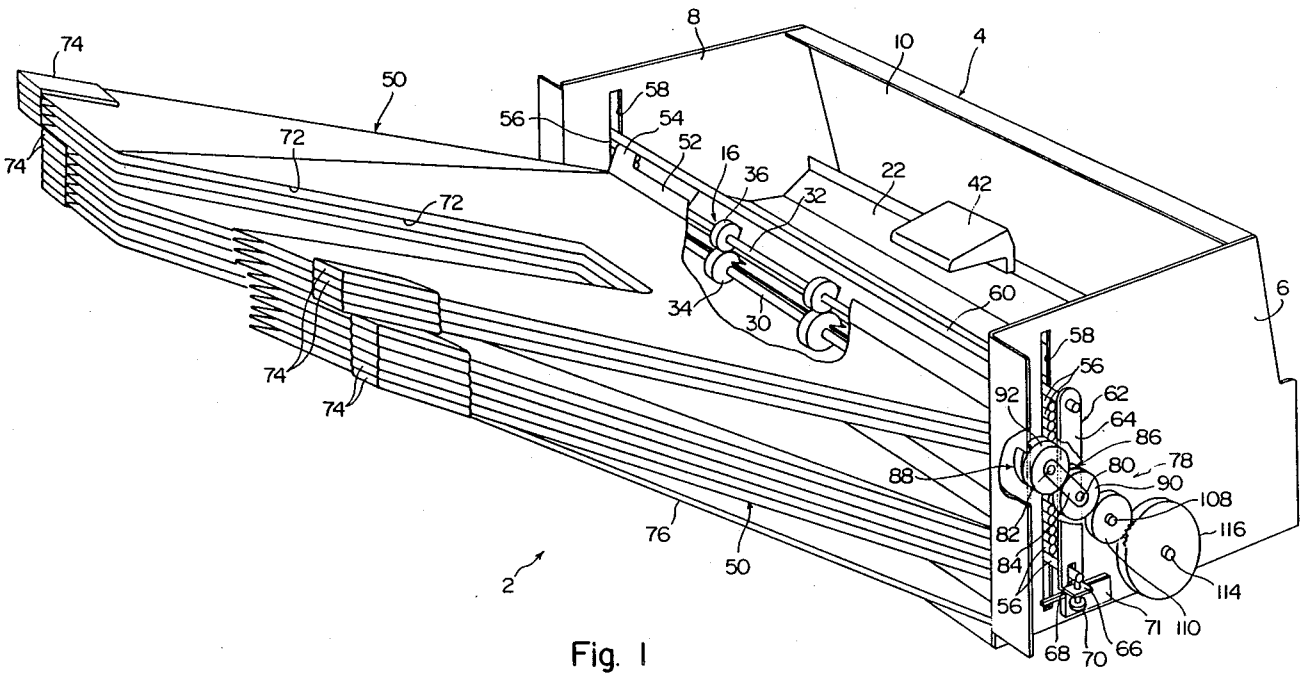
FIG. 1 is a perspective view, partly broken away, of a first embodiment of the sorter constructed in accordance with this invention.
Figure 2:
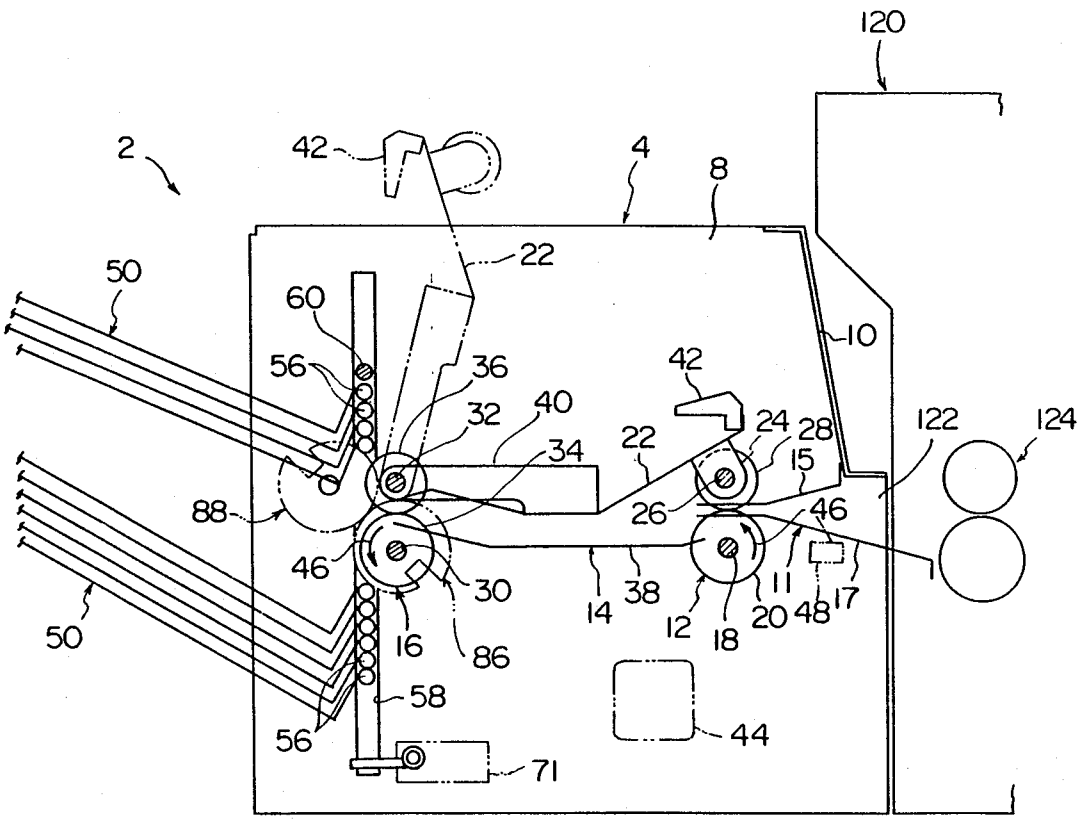
FIG. 2 is a simplified sectional view showing part of the sorter of FIG. 1.

With reference to FIGS. 1 and 2, the illustrated sorter shown generally by reference numeral 2 is provided with a stationary supporting frame 4. The supporting frame 4 has a front upstanding side plate 6 and a rear upstanding side plate 8 which are disposed in spaced-apart relationship in the width direction (a direction perpendicular to the sheet surface in FIG. 2) and a linking plate 10 extending across the upper half portions of the upstream ends (the right ends in FIG. 2) of the side plates 6 and 8. As shown in FIG. 2, a first guide plate pair 11, a first conveyor roller pair 12, a second guide plate pair 14 and a second conveyor roller pair 16 are disposed successively in the downstream direction between the side plates 6 and 8. More specifically, an upper guide plate 15 and a lower guide plate 17 in the first guide plate pair 11 are fixed between the side plates 6 and 8. A substantially horizontally extending rotating shaft 18 is rotatably mounted between the side plates 6 and 8 and a plurality of (for example, four) rollers 20 are fixed to the rotating shaft 18 at suitable intervals in the width direction.

Downwardly extending pieces 24 are formed integrally at both sides of the upstream end portion of an upper guide plate 22 in the second pair of guide plates 14. A substantially horizontally extending rotating shaft 26 is rotatably mounted between the downwardly extending pieces 24. A plurality of (for example, four) rollers 28, which constitute the first conveyor roller pair 12 in cooperation with the rollers 20, are fixed to the rotating shaft 26 at suitable intervals in the width direction. Substantially horizontally extending rotating shafts 30 and 32 are rotatably mounted between the side plates 6 and 8 with a space between them in the vertical direction. A plurality of (for example, four) rollers 34 are fixed to the rotating shaft 30 at suitable intervals in the width direction. A plurality of (for example, four) rollers 36, which constitute the second conveyor roller pair 16 in cooperation with the rollers 34, are fixed to the rotating shaft 32 at suitable intervals in the width direction. Conveniently, the rotating shaft 32 to which the rollers 36 are secured is mounted so as to be free to move over some range in the vertical direction and is elastically biased downwardly by a suitable spring means (not shown), and thus, the rollers 36 are pressed elastically against the rollers 34. A lower guide plate 38 in the second pair of guide plates 14 is fixed between the side plates 6 and 8. On the other hand, projecting pieces 40 are formed integrally at both sides of the downstream portion of the upper guide plate 22 in the second guide plate pair 14, and by idly fitting the downstream end portions of the projecting pieces 40 with the rotating shaft 32, the upper guide plate 22 is pivotally mounted on the rotating shaft 32. Usually, the upper guide plate 22 is held by its own weight, at a closed position shown in FIG. 2 at which the rollers 28 fixed to the rotating shaft 26 mounted on the guide plate 22 abut with the rollers 20. As is clearly shown in FIG. 1, a gripping piece 42 is fixed to the upstream end portion of the upper surface of the upper guide plate 22. It is possible to grip the gripping piece 42, move the upper side plate 22 as shown by a two-dot chain line in FIG. 2, and thus separate the rollers 28 from the rollers 20, and open a conveying passage defined by the pair of guide plates 14. The rotating shaft 18 in the first conveying roller pair 12 and the rotating shaft 30 in the second conveying roller pair 16 are drivingly coupled to a driving source 44 which may be an electric motor by a suitable power transmission mechanism (not shown), and the first conveying roller pair 12 and the second conveying roller pair 16 are rotated in he direction shown by arrow 46. In the illustrated embodiment, a detector 48 is also disposed for detecting a sheet conveyed through the conveying passage defined by the pair of guide plates 11. The detector 48 may be a microswitch having a detecting arm projecting between the guide plates 15 and 17.

With reference to FIG. 1, the sorter 2 further has a plurality of (ten in the drawing) bin trays 50. In refering to the order of a particular bin tray in a series of bin trays, it is counted from above unless otherwise specified. Each of the bin trays 50 may be of a nearly rectangular plate form on the whole. An end wall 52 projecting upwardly by some distance is formed integrally in the upper end of each of the bin trays 50, and projecting piece 54 further projecting upwardly is formed integrally in each of the side portions of the end wall 52. The inside end portion of a widthwise projecting trunnion 56 is fixed to the projecting piece 54. The trunnion 56 may be a pin having a circular cross-sectional surface. On the other hand, as clearly shown in FIGS. 1 and 3, a substantially vertically extending elongate slot 58 is formed in each of the side plates 6 and 8 of the stationary supporting frame 4. The lateral size of the slot 58 corresponds to the diameter of the trunnion 56. The trunnions 56 provided in the front and rear sides of the upper end portion of each of the bin trays 50 project outwardly in the width direction through the slots 58 formed in the side plates 6 and 8. Thus, the trunnions 56 are stacked in a substantially vertical direction in such a manner that they are free to move in a substantially vertical direction along the slots 58. In the states shown in FIGS. 1 and 3, the upstream end of the fourth bin tray 50 from above is vertically spaced from the upstream end of the fifth bin tray 50 by the action of the transfer mechanism to be described. Accordingly, the trunnions 56 in four bin trays 50 from the first to the 4th are contacted successively in the vertical direction. The trunnions 56 of six bin trays 50 from the 5th to the 10th are also contacted successively in the vertical direction. However, the trunnions 56 of the 4th bin trays 50 and the tunnions 56 of the fifth bin tray 50 are spaced apart from each other.

Figure 3:
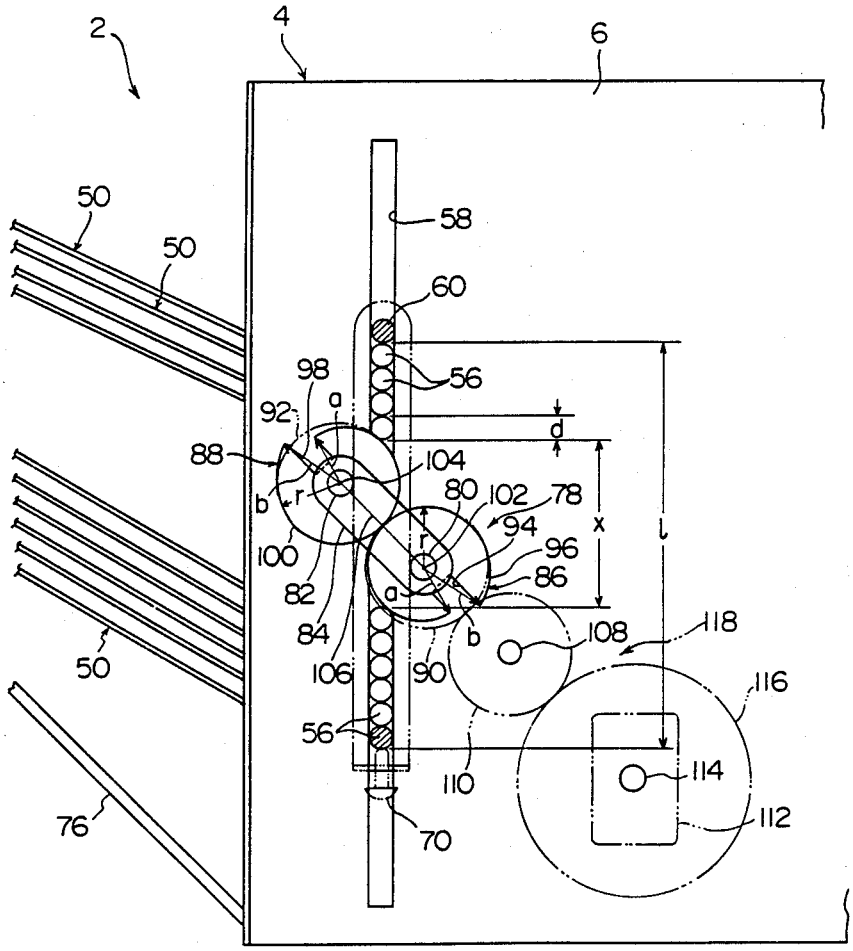
FIG. 3 is simplified side view showing a transfer mechanism in the sorter of FIG. 1.

In the illustrated embodiment, a rod 60 is also provided which extends continuously in the width direction above the trunnions 56 of the first bin tray 50. The front end portion of the rod 60 whose cross-sectional surface may be circular projects forwardly through the slot 58 formed in the side plate 6. The rear end portion of the rod 60 projects rearwardly through the slot 58 formed in the side plate 8. As shown clearly in FIG. 1, the front end portion of the rod 60 projects forwardly beyond the front ends of the front trunnions of the 1st to the 9th bin trays, and the upper end portion of a lever 62 is fixed to the front end portion of the rod 60. The lever 62 has a main portion 64 extending downwardly substantially vertically and a bent portion 66 extending forwardly from the lower end of the main portion 64. A vertically extending slot 68 is formed in the lower end part of the main portion 64 of the lever 62. The front trunnion 56 of the first bin tray 50 from below (the 10th from above) extends forwardly beyond the front ends of the front trunnions 56 of the other bin trays 50 and passes through the slot 68. On the other hand, an adjusting screw 70 is secured to the bent portion 66 of the lever 62. The upper end of the adjusting screw 70 abuts with the under surface of the extended front end portion of the front trunnion 56 in the first bin tray 50 from below. It will be understood therefore that the distance 1 (FIG. 3) between the front trunnion 56 of the first bin tray 50 and the front trunnion 56 of the first bin tray 50 from below is maintained at a predetermined value microadjustable by the operation of the adjusting screw 70. The above distance 1 is adjusted to a value represented by $1=10d+x$ in which d is the diameter of the trunnion 56 and x is the distance between two trunnions 56 to be spaced from each other by the action of the transfer mechanism to be described (FIG. 3). Conveniently, the same arrangement (lever 62 and adjusting screw 70) may be provided with regard to the rear trunnions 56 of the bin trays 50 and the rear end portion of the rod 60. If desired, in order to maintain the above distance 1 at a predetermined value, a spring means for elastically upwardly biasing the trunnion 56 of the first bin tray from below may be used in place of the adjusting screw 70. Furthermore, in the illustrated embodiment, the slots 58 formed in the side plates 6 and 8 extend substantially vertically, but if desired, the slots 58 may be designed to extend upwardly wholly or partly while inclining to the upstream or downstream side, as disclosed, for example, in the above-cited U.S. Pat. Nos. 4,328,963 and 4,332,377. In the illustrated embodiment, a detector 71 (FIGS. 1 and 2) is further provided in the side plate 6. This detector 71 may be a microswitch having a detecting arm extending across the lower portion of the slot 58 formed in the side plate 6. When the ten bin trays are in the initial state in which all of them are not elevated by the transfer mechanism to be described but the trunnions 56 of all bins are successively kept in contact in the vertical direction, the front trunnion 56 of the first bin tray 50 from below acts on the detector 50. As a result, the detector 71 detects the fact that the ten bin trays 50 are in the initial state.

As clearly shown in FIG. 1, each of the bin trays 50 extend to the downstream side beyond the stationary supporting frame 4. Conveniently, a notch 72 may be formed in each of the bin trays 50 extending upstream from the downstream end in the central portion of the bin tray in the width direction. Furthermore, in the illustrated embodiment, cam blocks 74 are fixed to both sides of the downstream end portion of each of the bin trays 50 and the cam blocks 74 of the bin trays 50 are stacked in a contacting relationship on both sides of the bin trays. It will be understood from the description given hereinafter that the cam blocks 74 adjoining vertically can be moved in the upstream and downstream directions relative to each other and are stacked pivotablly. The illustrated sorter 2 further has disposed therein a stationary supporting plate 76 fixed between the side plates 6 and 8 of the stationary supporting frame 4 and extending inclinedly upwardly in the downstream direction from its upstream end. As is clearly seen from FIG. 1, the downstream end portion of the first bin tray 50 from below abuts with the downstream end of the stationary supporting frame 76 and is supported by it. The downstream portions of the other bin trays 50 are indirectly supported by the downstream end of the stationary supporting plate 76 by the abutting of each of the cam blocks 74 with the cam block 74 of the bin tray 50 immediately below it. If desired, instead of fixing the upstream end of the supporting plate 76 to the stationary supporting frame 4, it is possible to fix the upstream end of the supporting plate 76 to the lever 62 via a suitable member so that when the lever 62 is elevated or lowered as stated below, the supporting plate 76 is elevated and lowered incident to it.

The sorter 2 further has a transfer mechanism 78. With reference to FIGS. 1 and 3, two short rods 80 and 82 projecting forwardly substantially horizontally are implanted in the front upstanding side plate 6. The free ends of the two short rods 80 and 82 are linked to each other by a reinforcing linking piece 84. Conveniently, the short rod 80 is concentric with the rotating shaft 30. On the short rods 80 and 82 are rotatably mounted rotating cam plates 86 and 88 and also gears 90 and 92, respectively. The rotating cam plate 86 and the gear 90 mounted on the short rod 80 are connected to each other by a suitable means such as a key (not shown) so as to rotate as a unit. Likewise, the rotating cam plate 88 and the gear 92 are connected by a suitable means such as a key (not shown) so as to rotate as a unit. If desired, the rotating cam plate 86 and the gear 90 may be formed as a one-piece unit; so can the rotating cam plate 88 and the gear 92. The gears 90 and 92 are substantially identical and are in mesh with each other. Accordingly, the rotating cam plates 86 and 88 are drivingly connected so that they rotate at substantially the same rotating speed in opposite directions to each other. As shown clearly in FIG. 3, a trunnion receiving groove 94 extending radially and being open at its radial outside end is formed in the rotating cam plate 86. The width of the trunnion receiving groove 94 corresponds to the diameter of the trunnion 56 provided in the bin tray 56. An outer circumferential cam surface 96 extending contiouously in the circumferential direction excepting the site of the trunnion receiving groove should be a convoluted surface whose radius r progressively increases from one side of the trunnion receiving groove 94 to the other side when viewed clockwise in FIG. 3. The outer circumferential surface 96 in the illustrated embodiment is an Archimedian convoluted surface in which the rotio of the rotating angle $\theta$ to the increase of the radius r are constant when viewed clockwise. Specifically, let the minimum radius in the outer circumferential surface 96 be a, the radius r of the outer circumferential cam surface 96 at a position spaced from the position of the minimum radius a by the rotating angle $\theta$ is $r=a+n\theta$ where n is a constant. The difference (b-a) between the maximum radius b and the minimum radius a in the outer circumferential cam surface 96 corresponds to the diameter of one trunnion 56, and preferably $(b-a)\approx d$. The rotating cam plate 88 is of quite the same shape as the rotating cam plate 86. Specifically, a trunnion receiving groove 98 extrending radially and being opened at its radial outside end is formed in the rotating cam plate 88. An outer circumferential cam surface 100 extending continuously in the circumferential direction excepting the site of the trunnion receiving groove 98 is a convoluted surface in which the radius r progressively increases from one side of the trunnion receiving groove 98 to the other side when viewed clockwise in FIG. 3, preferably an Archimedian convoluted surface in which the radius of the outer circumferential cam surface 100 at a position spaced from the position of the minimum radius a by an angle $\theta$ is expressed by the above formula $r=a+n\theta$.

Figure 4:
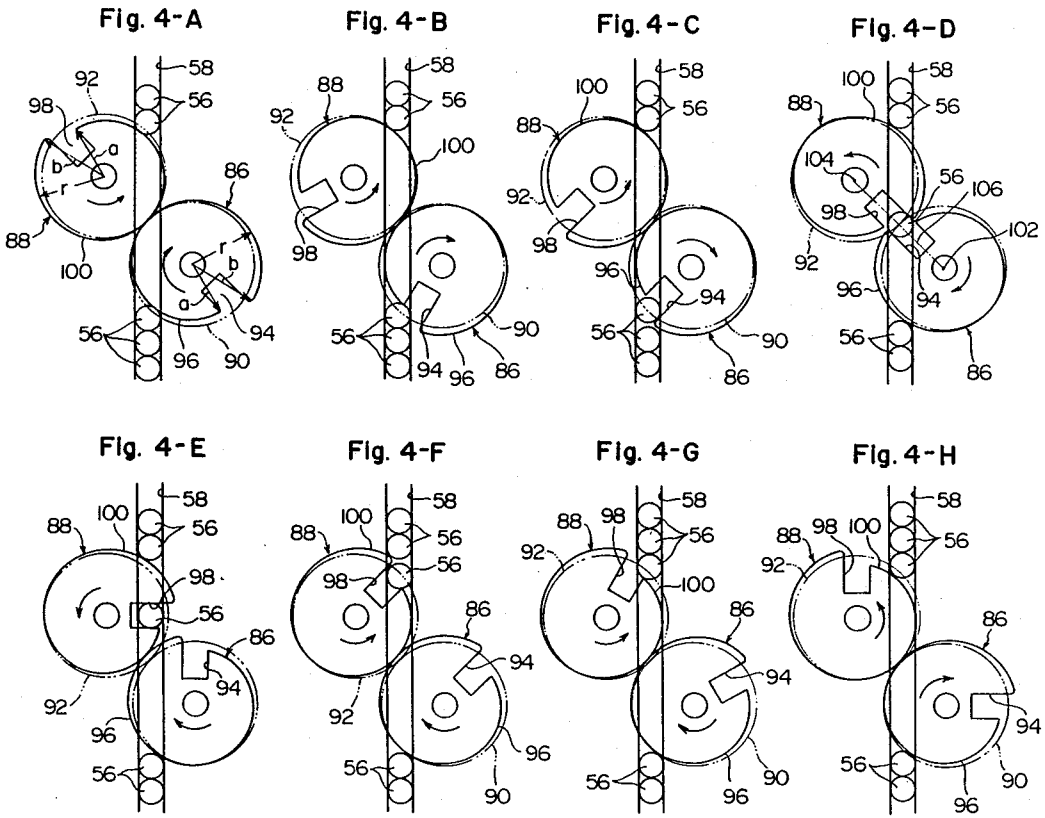
FIGS. 4-A to 4-H are simplified views for illustrating the action of the transfer mechanism in the sorter of FIG. 1.

It is clearly shown in FIG. 3 that the central axes of the short rods 80 and 82, and therefore rotating central axes 102 and 104 of the rotating cam plates 86 and 88, are positioned on both sides of the moving passage of the trunnion defined by the slot 58 formed in the side plate 6. The rotating central axes 102 and 104 are arranged deviatingly in the vertical direction, and a straight line 106 connecting the axes 102 and 104 obliquely crosses the moving passage of the trunnion 56 at an inclination of angle of, for example 45 degrees. The rotating cam plates 86 and 88 rotated at substantially the same rotating speed in opposite directions to each other are disposed in a given angular relation such that the trunnion receiving groove 94 faces the trunnion receiving groove 98 at a point of crossing of the straight line 106 and the slot 58, as shown in FIG. 4-D. It will be understood by reference to FIGS. 4-C and 4-E as well as FIG. 4-D that when the rotating cam plate 86 is rotated clockwise, and the rotating cam plate 88 counterclockwise, from the state shown in FIG. 4-C, the radius r of the outer circumferential cam surface 96 of the rotating cam plate 86 progressively decreases, and the radius r of the outer circumferential cam surface 100 of the rotating cam plate 88 progressively increases, at the above point of crossing. Conversely, when the rotating cam plate 86 is rotated counterclockwise, and the rotating cam 88 clockwise, from the state shown in FIG. 4-C, the radius r of the outer circumferential cam surface 96 of the rotating cam plate 86 progressively increases, and the radius r of the outer circumferential cam surface 100 of the rotating cam plate 88 progressively decreases, at the above point of crossing. Accordingly, the outer circumferential cam surface 96 of the rotating cam plate 86 and the outer circumferential cam surface 100 of the rotating cam plate 88 do not interfere with each other at the point of crossing, and the rotating cam plates 86 and 88 are always kept in contact, or in proximity, with each other at the point of crossing.

Conveniently, the short rods 80 and 82, the reinforcing linking piece 84, the cam plates 86 and 88 and the gears 90 and 92 are likewise disposed in the rear side of the rear upstanding side plate 8 although they are not essential and not shown in the drawings.

Further, with reference to FIGS. 1 and 3, a substantially horizontally extending rotating shaft 108 is rotatably mounted between the side plates 6 and 8. The front end portion of the rotating shaft 108 projects forwardly through the side plate 6, and a gear 110 in mesh with the gear 90 is fixed to the front end portion. Likewise, the rear end portion of the rotating shaft 108 projects rearwardly through the side plate 8, and a gear 110 in mesh with the gear 90 is fixed to the rear end portion, although this is not shown in the drawing. Further, a driving source 112 (FIG. 3) which may be an electric motor is disposed in the inside surface of the side plate 6. The output shaft 114 of the driving source 112 projects forwardly through the side plate 6, and a gear 116 in mesh with the gear 110 disposed ahead of the side plate 6 is fixed to the front end portion of the output shaft 114. The driving source 112, the gears 116 and 110 as well as gears 90 and 92 constitute a driving source 118 for rotating the rotating cam plates 86 and 88. When the gear 116 is rotated clockwise in FIG. 3 by the driving source 112, the rotating cam plates 86 is rotated clockwise, and the rotating cam plate 88, counterclockwise. Conversely, when the gear 116 is rotated counterclockwise in FIG. 3 by the driving source 112, the rotating cam plate 86 is rotated counterclockwise, and the rotating cam plate 88, clockwise.

The operation and advantage of the sorter 2 described above will now be described. The sorter 2 illustrated in FIG. 2 is used, for example, in combination with an electrostatic copying machine 120. This sorter 2 is positioned with respect to the electrostatic copying machine 120 such that a sheet introducing passage 122 defined by the upstream end portion of the first guide plate pair 11 comes opposite to a sheet discharge opening in the copying machine 120. A sheet (copying paper) discharged from the copying machine 120 by a pair of discharge rollers 124 is fed to the first pair of conveyor rollers 12 via a space between the guide plates 15 and 17 of the first guide plate pair 11, and by the action of the first conveying roller pair 12, fed to the second pair of conveyor rollers 16 via a space between the guide plates 22 and 38 of the second guide plate pair, and then by the action of the second conveying roller pair 16, discharged onto any one of the bin trays 50. As shown in FIG. 2, when the 4th bin tray 50 and the 5th bin tray 50 are spaced from each other vertically at their receiving ends to form a sheet receiving opening between them, it will be easily seen that the sheet conveyed by the action of the second conveying roller pair 16 is discharged onto the 5th bin tray 50. Onto which of the bin trays 50 a given sheet is to be discharged can be selected by properly controlling the elevation and lowering of the trunnions 56 of the bin trays by the transfer mechanism 78.

Now, the action of the transfer mechanism 78 to elevate and lower the trunnions 56 will be described.

When the 4th bin tray 50 and the 5th bin tray 50 from above are vertically spaced from each other at their receiving ends as shown in FIGS. 1 to 3, the rotating cam plates 86 and 88 in the transfer mechanism 78 are maintained stationary, for example, at the angular position illustrated in FIG. 4-A. In this state, the trunnion 56 of the 4th bin tray is in contact with the outer circumferential cam surface 100 of the rotating cam plate 88, and the trunnion of the 5th bin tray is in contact, or in proximity, with the outer circumferential cam surface 96 of the rotating cam plate 86. In order to space the 5th bin tray 50 and the 6th bin tray 50 vertically from each other at their receiving ends by elevating the trunnion 56 of the 5th bin tray 50 and thereby to allow the sheet conveyed by the second pair of conveyor rollers 16 to be discharged onto the 6th bin tray 50, the driving source 112 of the transfer mechanism 78 is energized for a predetermined period of time to rotate the rotating cam plate 86 clockwise and the rotating cam plate 88 counterclockwise each through one turn. While the rotating cam plates 86 and 88 are being rotated from the angular position shown in FIG. 4-A to the angular position shown in FIG. 4B, the radius of the outer circumferential cam surface 100 of the rotating cam plate 88 progressively increases at that site with which the trunnion 56 of the 4th bin tray 50 is in contact. Hence, the trunnion 56 of the 4th bin tray 50 is gradually elevated. As a result, as can be seen from FIGS. 1 and 3, the rod 60 and the lever 62 are gradually elevated together with the trunnions 56 of the 3rd, 2nd and 1st bin trays 50. Thus, the trunnions 56 of the 5th, 6th, 7th 8th, 9th and 10th bin trays 50 are also elevated. While the rotating cam plates 86 and 88 are rotated from the angular position shown in FIG. 4-A to the angular position shown in FIG. 4-B, the radius of the outer circumferential cam surface 96 of the rotating cam plate 86 progressively decreases, according to the increase of the radius of the outer circumferential cam surface 100 of the rotating cam plate 88, at that site with which the trunnion 56 of the 5th bin tray 50 is in contact, or in proximity. Consequently, the gradually rising trunnion 56 of the 5th bin tray 50 continues to contact or approach the outer circumferential cam surface 96 of the rotating cam plate 86. When the rotating cam plates 86 and 88 have been rotated to the angular position shown in FIG. 4-C, the trunnion 56 of the 5th bin tray 50 advances into the trunnion receiving groove 94 of the rotating cam plate 86, and the trunnion 56 of the 6th bin tray contacts or approaches the outer circumferential cam surface 96 of the rotating cam plate 86. The trunnions 56 of the 1st to the 10th bin trays 50 are also gradually elevated for the reason mentioned above while the rotating cam plates 86 and 88 are being rotated from the angular position shown in FIG. 4-B to the angular position shown in FIG. 4-C. When the rotating cam plates 86 and 88 have been rotated to the angular position shown in FIG. 4-D, the trunnion 56 of the 5th bin tray 50 is elevated at a relatively high speed incident to the rotation of the rotating cam plate 86 by the restraining action of the trunnion receiving groove 94, and is spaced upwardly from the trunnion 56 of the 6th bin tray 50. The trunnion 56 of the 6th bin tray 50 contacts or approaches the outer circumferential cam surface 96 of the rotating cam plate 86. Since at this time, the trunnion 56 of the 6th bin tray 50 has already been elevated a predetermined amount, it does not violently collide with the outer circumferential cam surface 96 of the rotating cam plate 86. When the rotating cam plates 86 and 88 further continue to rotate, the trunnion 56 of the 5th bin tray 50 gets out of the trunnion receiving groove 94 of the rotating cam plate 86 and advances into the trunnion receiving groove 98 of the rotating cam plate 88, as can be seen by comparing FIG. 4-D with FIG. 4-E. Thus, while the rotating cam plates 86 and 88 are being rotated to the angular position shown in FIG. 4-F, the trunnion 56 of the 5th- bin tray 50 is further elevated at a relatively high speed incident to the rotation of the rotating cam plate 88 by the restraining action of the trunnion receiving groove 98. While the rotating cam plates 86 and 88 are being rotated from the angular position shown in FIG. 4-C to the angular position shown in FIG. 4-F, the radius of the outer circumferential cam surface 100 of the rotating cam plate 88 progressively increases at that site with which the trunnion 56 of the 4th bin tray 50 makes contact, and at that site which the trunnion 56 of the 6th bin tray 50 contacts or approaches, the radius of the outer circumferential cam surface 96 of the rotating cam plate 86 progressively decreases. Accordingly, the trunnions 56 of the 1st to 4th and 6th to 10th bin trays 50 are gradually elevated. When the rotating cam plates 86 and 88 further continue to ratate, the trunnion 56 of the 5th bin tray 50 gets out of the trunnion receiving groove 98 of the rotating cam plate 88 and makes contact with the outer circumferential cam surface 100 of the rotating cam plate 88, as is shown in FIG. 4-G. By this time, the trunnion 56 of the 4th bin tray 50 has already been elevated by a distance nearly corresponding to the diameter of the trunnion 56. Accordingly, the trunnion 56 of the 5th bin tray 50 can get out of the trunnion receiving groove 98 of the rotating cam plate 88 without violently colliding with the trunnion 56 of the 4th bin tray 50. It is appreciated by reference to FIG. 1 that while the trunnion 56 of the 5th bin tray 50 is being elevated at a relatively high speed by the action of the trunnion receiving groove 94 on the rotating cam plate 86 and the trunnion receiving groove 98 on the rotating cam plate 88, the cam blocks 74 provided on both sides of the downstream end portion of the 5th bin tray 56 slide slightly downstream over the cam blocks 74 of the bin tray 50 positioned immediately below the first-mentioned cam blocks, and simultaneously pivoted counterclockwise when viewed from ahead. The rotating cam plates 86 and 88 are continued to rotate to the angular position shown in FIG. 4-A past the angular position shown in FIG. 4-H. During this time, too, the radius of the outer circumferential surface 100 of the rotating cam plate 88 progressively increases at that site which the trunnion 56 of the 5th bin tray 50 contacts, and the radius of the outer circumferential cam surface 86 of the rotating cam plate 86 progressively decreases at that site which the trunnion 56 of the 6th bin tray 50 contacts or approaches. Accordingly, the trunnions of the 1st to the 10th bin trays 50 are gradually elevated. When the rotating cam plates 86 and 88 have been rotated through one turn and are again at the angular position shown in FIG. 4-A, the 5th bin tray 50 and the 6th bin tray 50, instead of the 4th and 5th bin trays 50, are spaced vertically from each other at their receiving ends, and the sheet conveyed by the 2nd pair of conveying rollers 16 is now in condition for discharge onto the 6th bin tray. When the rotating cam plate 86 is successively rotated clockwise through one turn and the rotating cam plate 88 is successively rotated counterclockwise through one turn, sheets conveyed by the action of the second pair of conveying rollers 16 are in condition for discharge onto the 7th to 10th bin trays 50 successively. Energization of the driving source 112 for rotating the rotating cam plates 86 and 88 may be started, for example, after the lapse of a predetermined period of time from the time when the detector 48 (FIG. 2) detects the trailing end of the previous sheet.

On the other hand, in order to create a condition in which the sheet is to be discharged onto the 4th bin tray 50 from the condition shown in FIGS. 1 and 3, i.e. the condition in which the sheet conveyed by the second pair of conveying rollers 16 is to be discharged onto the 5th bin tray 50, the rotating cam plate 86 is rotated counterclockwise through one turn and the rotating cam plate 88 is rotated clockwise through one turn. As a result, the trunnion 56 of the 4th bin tray 50 is lowered at a relatively high speed by a predetermined distance by the action of the trunnion receiving groove 98 of the rotating cam plate 88 and the trunnion receiving groove 94 of the rotating cam plate 86, and all the trunnions 56 are gradually lowered continuously by a distance corresponding to the diameter of one trunnion 56, as can be understood by seeing FIGS. 4-A to 4-H in the opposite direction from the case described above. Thus, instead of the 4th and 5th bin trays 50, the 3rd and 4th bin trays 50 are spaced vertically from each other at their receiving ends, add the sheet conveyed by the action of the second conveying roller pair 16 is in condition for discharged onto the 4th bin tray 50. While the trunnion 56 of the 4th bin tray 50 is lowered at a relatively high speed by the action of the trunnion receiving groove 98 of the rotating cam plate 88 and the trunnion receiving groove 94 of the rotating cam plate 86, the cam blocks 74 provided on both sides of the downstream end portion of the 4th bin tray 50 slide slightly upstream over the cam blocks 74 of the bin tray 50 immediately below it and are pivoted clockwise when viewed from ahead, as can be understood by reference to FIG. 1. When the rotating cam plate 86 is further rotated counterclockwise through one turn and the rotating cam plate 88 is rotated further clockwise through one turn successively, sheets conveyed by the action of the second pair of conveying rollers 16 are in condition for discharge onto the 3rd to 1st bin trays successively.

In the illustrated transfer mechanism 78, one trunnion receiving groove 94 or 98 is provided respectively in the cooperating rotating cam plates 86 and 88. If desired, it is possible to form two or three or more trunnion receiving grooves at angular intervals in each of the rotating cam plates 86 and 88. In this case, the outer circumferential cam surface 96 between two adjacent trunnion receiving grooves 94 and the outer circumferential cam surface 100 between two adjacent trunnion receiving grooves 98 are preferably formed in an Archimedian convoluted surface whose radius progressively increases from its minimum radius a to its maximum radius b, and instead of rotating the rotating cam plates 86 and 88 through one turn, they are rotated through 360° /n turn in which n is the number of the trunnion receiving grooves 94 and 98 respectively.

According to the transfer mechanism 78 constructed in accordance with this invention, when the rotating cam plates 86 and 88 are rotated through one turn in order to elevate a given trunnion 56 (for example, the trunnion 56 of the 5th bin tray 50) by a predetermined distance by the action of the trunnion receiving grooves 94 and 98 of the rotating cam plates 86 and 88 or to lower a given trunnion 56 (for example, the trunnion 56 of the 4th bin tray 50) by a predetermined distance by the action of the trunnion receiving grooves 94 and 98 of the rotating cam plates 86 and 88, all the trunnions 56 are gradually elevated or lowered successively during the entire one-turn rotation of the rotating cam plates 86 and 88 described above. Hence, the elevation or lowering of the trunnions 56 is sufficiently smooth, and no excessive impact is produced. The transfer of the trunnions 56 can thus be carried out at a sufficiently high speed, and the trunnion can function well over a long period of time without excessive wear.

Figure 5:
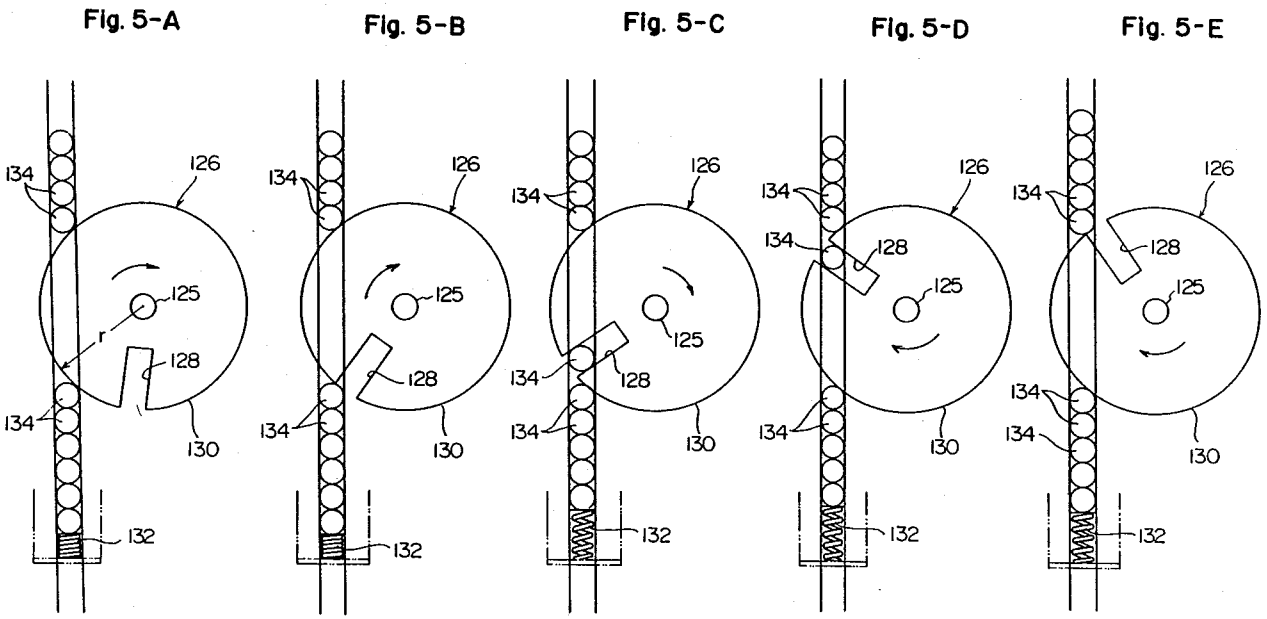
FIGS. 5-A to 5-E are simplified views for illustrating the problem of a conventional Geneva rotating cam-type transfer mechanism.

On the other hand, the conventional Geneva rotating cam-type transfer mechanism disclosed, for example, in U.S. Pat. No. 4,328,963 has the following problems. With reference to FIGS. 5-A to 5-E, the conventional Geneva rotating cam-type transfer mechanism is provided with a Geneva circular plate cam 126 mounted rotatably on a shaft 125 instead of the aforesaid pair of rotating cam plates 86 and 88. At least one trunnion receiving groove 128 extending radially and being open at its radially outside end is formed in the circular plate cam 126 as is the case with the rotating cam plate 86 or 88. However, in the circular cam 126, the outer circumferential cam surface 130 extending continuously in the circumferential direction excepting the site of the trunnion receiving groove 128 is not a convoluted surface but an arcuate surface having a constant radius When in this Geneva rotating cam-type transfer mechanism, a condition in which the 5th and 6th bin trays are spaced vertically from each other at their receiving ends is to be created from a condition in which the 4th and 5th bin trays are spaced vertically from each other at their receiving ends, the circular cam plate 126 is rotated clockwise through one turn. While the circular plate cam 126 is rotated from the angular position shown in FIG. 5-A to the angular position shown in FIG. 5-B, a trunnion 134 of the 5th bin tray is elastically kept in contact with the outer circumferential cam surface 130 of the circular plate cam 126 by the elastic upwardly biasing action of a spring means 132. The trunnion 134 of the 4th bin tray is also kept in contact with the outer circumferential cam surface 130 of the circular plate cam 126 by the weight of the bin tray, etc. Since, however, the outer circumferential cam surface 130 is an arculate surface having a constant radius r, the trunnions 134 of all bin trays are not elevated but remain stationary while the circular plate cam 126 is rotated from the angular position shown in FIG. 5-A to the angular position shown in FIG. 5-B. When the circular plate cam 126 is further rotated clockwise beyond the angular position shown in FIG. 5-B, the trunnion 134 of the 5th bin tray advances into the trunnion receiving groove 128 in the circular plate cam 126 and is elevated at a relatively high speed incident to the rotation of the circular plate cam 126, as is shown in FIG. 5-C. On the other hand, as can be understood by comparing FIG. 5-B with FIG. 5-C, during a very short period of time when the circular plate cam 126 rotates clockwise from the angular position shown in FIG. 5-B over a small angular range corresponding to the width of the trunnion receiving groove 128 (therefore, the diameter of the trunnion 134), the trunnions 134 of the 6th to 10th bin trays are abruptly elevated by a distance corresponding to the diameter of one trunnion 134 by the elastic upwardly biasing action of the spring means 132, and the trunnion 134 of the 6th bin tray comes into collision with the outer circumferential cam surface 130 of the circular plate cam 126. While the circular plate cam 126 is rotated from the angular position shown in FIG. 5-C to the angular position illustrated in FIG. 5-D, the trunnion 134 of the 5th bin tray is elevated at a relatively high speed incident to the rotation of the circular plate cam 126, but the trunnions 134 of the remaining bin trays (i.e., 1st to 4th and 6th to 10th bin trays) remain stationary without being elevated. When the circular plate cam 126 is further rotated clockwise beyond the angular position shown in FIG. 5-D, the trunnion 134 of the 5th bin tray gets out of the trunnion receiving groove 128 of the circular plate cam 126 and makes contact with the outer circumferential cam surface 130 of the circular plate cam 126. As can be seen by comparing FIG. 5-D with FIG. 5-E, during a very short period of time when the circular plate cam 126 rotates clockwise over a small angular range corresponding to the width of the trunnion receiving groove 128 (i.e., the diameter of the trunnion 134) to the angular position shown in FIG. 5-E, the trunnion 134 of the 5th bin tray collides with the trunnion 134 of the 4th bin tray which has so far remained stationary in contact with the outer circumferential cam surface 130 of the circular plate cam 126. Then, according to the elevation of the trunnion 134 of the 5th bin tray, the trunnions 134 of the 1st to 4th bin trays are abruptly elevated by a distance corresponding to the diameter of one trunnion 134. While the circular plate cam 126 is further rotated clockwise beyond the angular position shown in FIG. 5-E and returns to the angular position shown in FIG. 5-A, the trunnions of all bin trays remain stationary.

When the circular plate cam 126 is rotated counterclockwise, and therefore the 4th- trunnion 134 is lowered at a relatively high speed by the action of the trunnion receiving groove 128 of the circular plate cam 126, the aforesaid collision and abrupt lowering also occur when the trunnion 134 of the 4th bin tray comes into and out of the trunnion receiving groove 128, as can be understood by seeing FIGS. 5-A to 5-E in the opposite direction to the aforesaid case.

Thus, collision and abrupt elevation or lowering occur in the conventional Geneva rotating cam-type transfer mechanism when a given trunnion 134 comes into and out of the trunnion receiving groove 128 of the circular plate cam 126. Accordingly, relatively large noises are produced in the conventional Geneva rotating cam-type transfer mechanism, and it is not suitable for high-speed of transfer of trunnions. Moreover, the transfer mechanism fails to function within a relatively short period of time owing to wear, etc.

Figure 6:
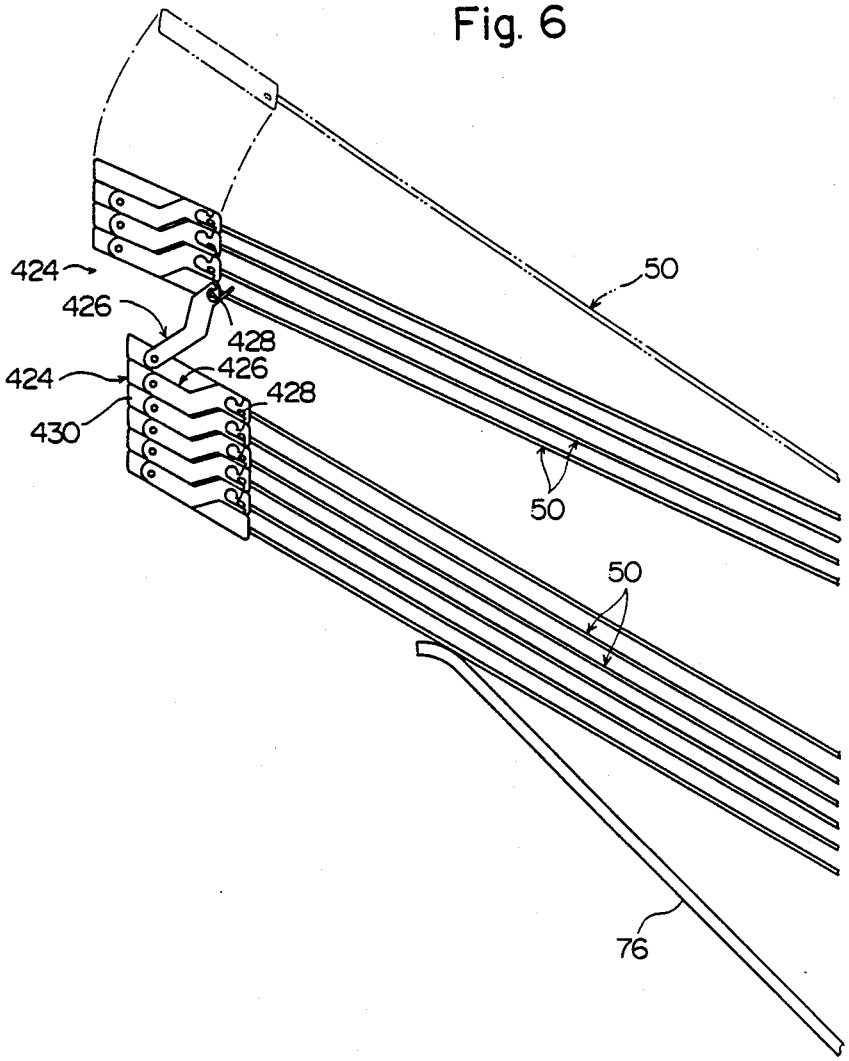
FIG. 6 is a side view showing improved cam means which can be disposed on both sides of the downstream end portions of bin trays.
Figure 7:
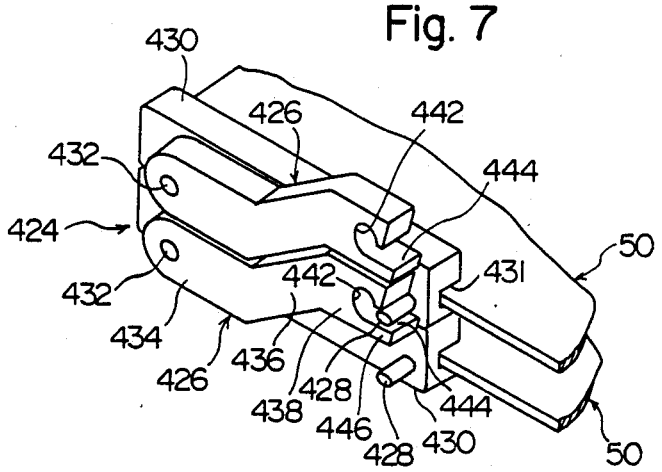
FIG. 7 is a partial perspective view showing the cam means of FIG. 6.
Figure 8:
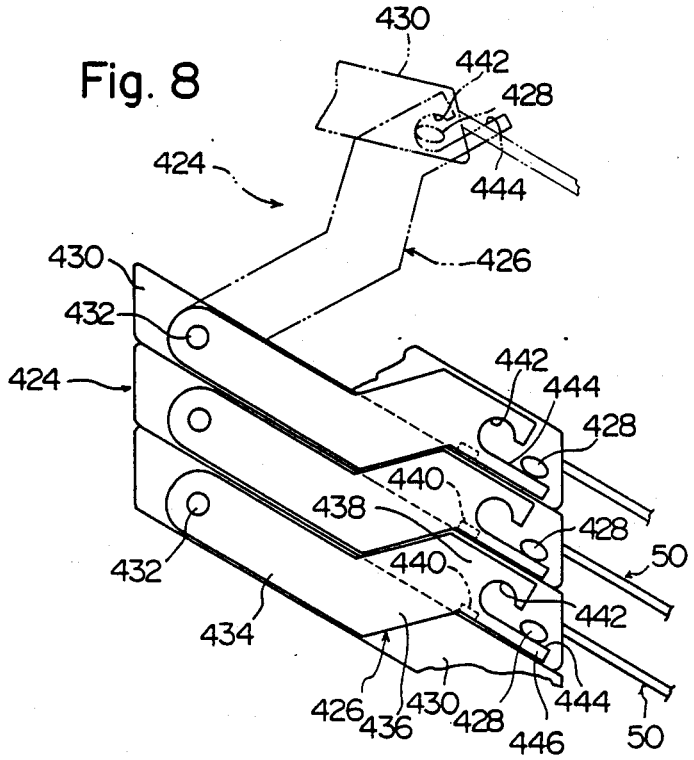
FIG. 8 is a pertial side view showing the cam means of FIG. 6.

FIGS. 6 to 8 illustrate cam means 424 of a unique construction which can be disposed on both sides of the downstream ends of bin trays 50 in place of the cam blocks 74 described above. Each cam means 424 includes, with regard to two vertically adjoining bin trays, a pivot member 426 disposed in the lower bin tray 50 and an engaging protrusion 428 disposed in the upper bin tray 50. Both the pivot member 426 and the engaging 10 protrusion 428 should be disposed in the 2nd to 9th bin trays 50. But in the 1st bin tray, the pivot member 426 is omitted, and in the 10th (1st from bottom) bin 50, the engaging protrusion 428 is omitted. As clearly shown in FIG. 7, nearly rectangular blocks 430 which may be made of a suitable synthetic resin are fixed to both ends of the downstream end portion of each of the bin trays 50. A groove 431 for receiving a side edge portion of the downstream end of the bin tray 50 is formed in the inside surface of each block 430. The blocks 430 may be bonded to desired sites of the bin trays 50 by a suitable adhesive. A supporting shaft 432 projecting substantially horizontally and outwardly in the width direction is formed integrally in the downstream end portion of the block 430 at its exterior side surface. The pivot member 426 is pivotally mounted on the supporting shaft 432. The pivot member 426 which may be formed of a suitable synthetic resin is nearly Z-shaped, and has a base portion 434, an inclined portion 436 a free end portion 438. A stopping protrusion 440 (FIG. 8) projecting inwardly in the width direction is formed integrally in the interior side surface of the free end portion 438. The stopping protrusion 440 abuts with the upper surface of the block 430 to prevent the pivot member 426 from pivoting clockwise in FIG. 8 beyond the stop position shown by a solid line in FIG. 8. In other words, the pivot member 426 is mounted so that it is free to pivot counterclockwise in FIG. 8 (in a direction in which the free end portion 438 is elevated) from a predetermined stop position at which its stopping protrusion 440 abuts with the upper surface of the block 430. In the free end portion 438 of the pivot member 426 is formed an engagement portion 442 which may be a depressed portion open on the upstream side and having a nearly circular cross-sectional surface. The free end portion 438 further has formed therein integrally a projecting piece 446 which defines a guide surface 444 extending upstream from the engagement portion 442. The engaging protrusion 428 cooperating with the pivot member 426 described above is formed integrally in the upstream end portion of the outside surface of the block 430, and projects outwardly in the width direction and substantially horizontally from the outside surface of the block 430. Conveniently, the cross-sectional surface shape of the engaging protrusion 428 is circular or elliptical.

It will be easily appreciated by reference to FIGS. 7 and 8 that when the vertically adjoining bin trays 50 are in a normal condition in which the upstream ends of the bin trays 50 are not spaced vertically from each other, the blocks 430 of the upper bin tray 50 are directly placed in abutment with the blocks 430 of the lower bin tray 50 and the downstream end portion of the upper bin tray 50 is stacked on the downstream end portion of the lower bin tray 50. In this condition, the engaging protrusion 428 of the upper bin tray 50 is positioned on the guide surface 444 of the lower bin tray 50. The engaging protrusion 428 of the upper bin tray 50 has not yet engaged the engagement portion 442 of the lower bin tray 50. Accordingly, as is shown by a two-dot chain line in FIG. 6 with regard to the first bin tray 50, it is possible to elevate the downstream end portion of the upper bin tray 50 manually (at this time, the bin tray 50 is pivoted clockwise in FIG. 6 about the trunnion 56 disposed at its upstream end) and space the two adjoining bin trays 50 manually to a great extent (this spacing is useful in the event of paper jamming between the bin trays 50).

It will be appreciated by reference to FIG. 6 that when the upstream end portion of a given bin tray 50 is elevated by the transfer mechanism 78 so as to space it upwardly from the upstream end portion of the bin tray 50 immediately below it, the downstream end portion of the given bin tray 50 is moved downstream with respect to the downstream end portion of the bin tray 50 immediately below it because the movement of the trunnion 56 by the transfer mechanism 78 is in a substantially vertical direction and the bin trays 50 are inclined upwardly in the downstream direction. When the downstream end portion of the given bin tray 50 is moved downstream, the engaging protrusion 428 of the cam means 424 in the given bin tray 50 slightly moves downstream on the guide surface 444 of the pivot member 426 of the cam means 424 in the bin tray 50 immediately below it, and advances into the engagement portion 442, as can be seen by reference to FIGS. 7 and 8. Then, as shown by a two-dot chain line in FIG. 8, as the engaging protrusion 428 moves downward, the pivot member 426 is pivoted in a predetermined direction (counterclockwise in FIG. 8) to a spacing position. This pivoting of the pivot member 426 elevates to engaging protrusion 428 together with the engagement portion 442 of the pivot member 426. Thus, the downstream end portion of the given bin tray 50 is spaced upwardly from the downstream end portion of the bin tray 50 immediately below it.

When the upstream end portion of the given bin tray 50 upwardly spaced wholly from the bin tray 50 below it is to be lowered by the transfer mechanism 78, the downstream end portion of the given bin tray 50 is moved upstream with respect to the downstream end portion of the bin tray 50 immediately below it. As a result, incident to the movement of the engaging protrusion 428 of the cam means 424 in the given bin tray 50 in the upstream direction, the pivot member 426 of the cam means 424 in the bin tray 50 immediately below it is pivoted from the spacing position in a direction opposite to the predetermined direction (the opposite direction is the clockwise direction in FIG. 8) and returned to the aforesaid stop position. Then, the engaging protrusion 428 moves upstream relative to the pivot member 426, disengages from the engagement portion 442 of the pivot member 426 and moves onto the guide surface 444.

While the above description is direction to the relation between the downstream end portion of the given bin tray 50 and the downstream end portion of the bin tray 50 immediately below it in the elevation and lowering of the upstream end portion of the given bin tray 50 by the transfer mechanism 78, the relation between the downstream end portion of the given bin tray 50 and the downstream end portion of the bin tray 50 immediately above it in the elevation and lowering of the upstream end portion of the given bin tray 50 is substantially the same as the above relation. When the upstream end portion of the given bin tray 50 is elevated and caused to approach the upstream end portion of the bin tray 50 immediately above it, the downstream end portion of the given bin tray 50 is moved downstream with respect to the downstream end portion of the bin tray 50 immediately above it, and therefore, the downstream end portion of the bin tray 50 immediately above it moves upstream relative to the given bin tray. Thus, the pivot member 426 of the cam means 424 in the given bin tray 50 is pivoted from the spacing position to a direction opposite to the aforesaid predetermined direction (this opposite direction is the clockwise direction in FIG. 8), and the downstream end portion of the given bin tray 50 thereby approaches the downstream end portion of the bin tray 50 immediately above it. When the upstream end portion of the given bin tray 50 is lowered and spaced downwardly from the upstream end portion of the bin tray 50 immediately above it, the downstream end portion of the given bin tray 50 moves upstream with respect to the downstream end portion of the bin tray 50 immediately above it, and therefore, the downstream end portion of the bin tray 50 immediately above it moves downstream relative to the given bin tray 50. As a result, the pivot member 426 of the cam means 424 in the given bin tray 50 is pivoted from the stop position in the aforesaid predetermined direction (the counterclockwise direction in FIG. 8), whereby the downstream end portion of the given bin tray 50 is spaced downwardly from the downstream end portion of the bin tray 50 immediately above it.

In the cam means 424, the pivot member 426 is pivoted in the predetermined direction by the action of the engaging protrusion 428, whereby the downstream end portion of the given bin tray 50 is elevated. In this way, the pivoting movement of the pivot member 426 is utilized instead of the sliding movement of the two cam block in order to space the downstream end portions of the adjacent bin trays 50 automatically. Accordingly, the downstream end portions of the adjacent bin trays 50 can be spaced sufficiently widely with a high motion converting efficiency while avoiding occurrence of unpleasant noises and increasing the durability of the bin trays.

FIGS. 9 to 13 shows a second embodiment of the sorter constructed in accordance with this invention.

Figure 9:
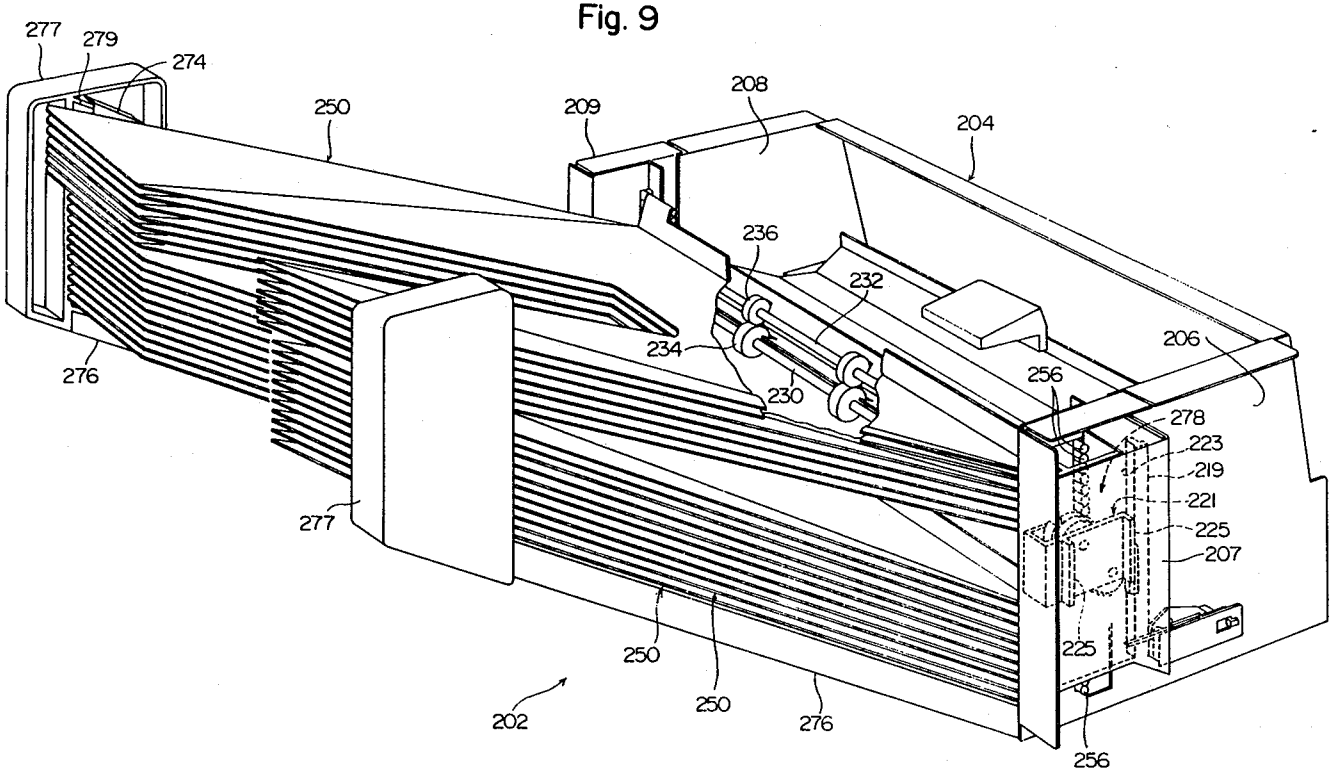
FIG. 9 is a partly-broken-away perspective view showing a second embodiment of the sorter constructed in accordance with this invention.
Figure 10:
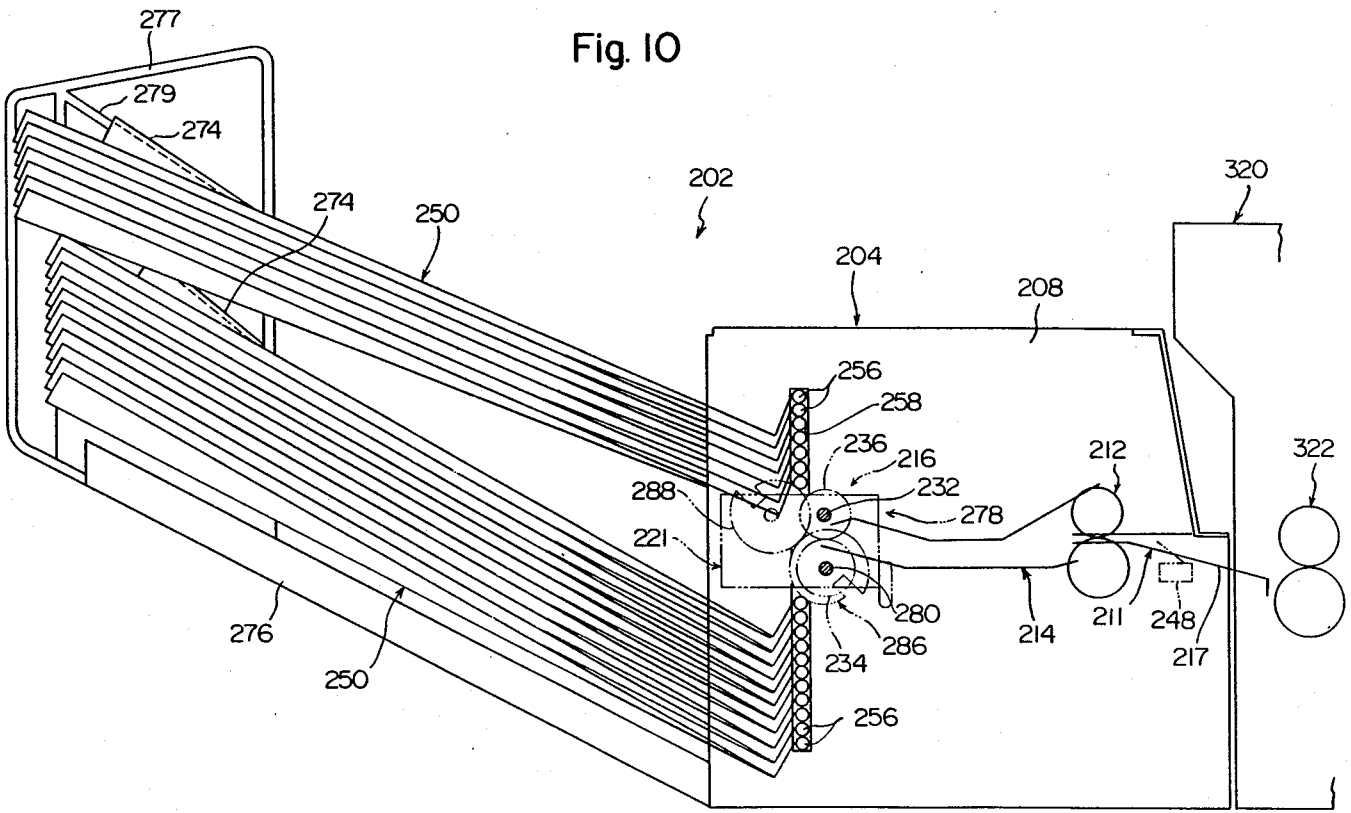
FIG. 10 is a simplified sectional view showing the sorter of FIG. 9.

With reference to FIGS. 9 and 10, the illustrated sorter shown generally at 202 is provided with a plurality of (18 in the drawing) vertically arranged bin trays 250. Supporting pieces 274 which project slightly upwardly and then outwardly in the width direction are formed integrally on both sides of the downstream end portion of each of the bin trays 250. The upstream ends of stationary supporting members 276 extending downstream and upwardly inclinedly are fixed respectively to the lower end portions of the inside surfaces of a front upright side plate 206 and a rear upright side plate 208 in a stationary supporting frame 204. A guiding member 277 which may be made of synthetic resin and extending substantially vertically upwardly is fixed to the downstream end portion of each of the stationary supporting members 276. A plurality of (18 in the drawing) guide rails 279 arranged at predetermined intervals in the vertical reaction and parallel to each other while being slightly upwardly inclined downstream are formed in the inside surfaces of each of the guide members 277. The protruding portion in the width direction of the supporting pieces 274 formed in the bin trays 250 are placed on the guide rails 279, respectively. Accordingly, the downstream end portions of the bin trays 250 are supported respectively by the guide rails 279 so that they slide freely along the rails and can pivot.

Figure 12:
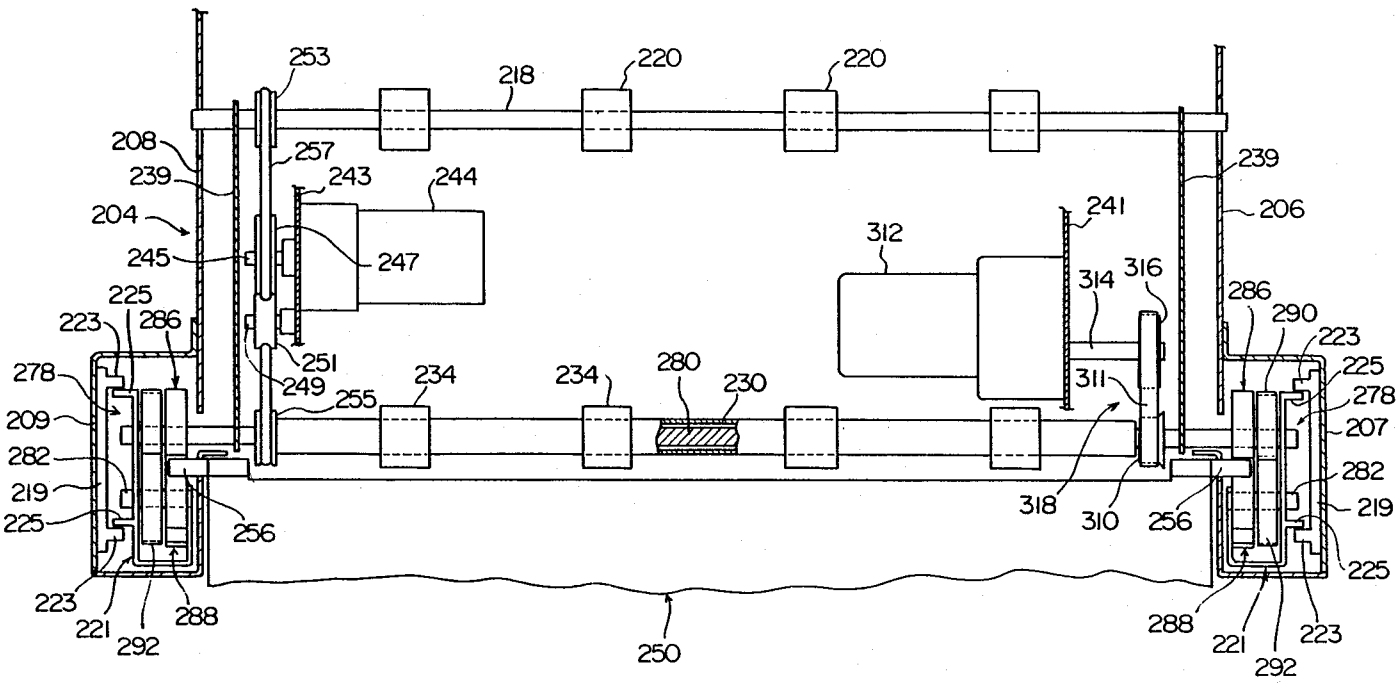
FIG. 12 is a sectional view showing part of the sorter of FIG. 9.

With reference to FIGS. 9 and 12, auxiliary side plates 207 and 209 having a nearly L-shaped cross-sectional shape are fixed respectively to the outside surfaces of the side plates 206 and 208 of the stationary supporting frame 204. A sliding member 221 slidable substantially vertically is disposed in each of a space defined by the side plate 206 and the auxiliary side plate 207 and a space defined by the side plate 208 and the auxiliary side plate 209. More specifically, a guide plate 219 is fixed to the inside surface of the main portion of each of the auxiliary side plates 207 and 209. A pair of guide rails 223 extending substantially vertically in spaced-apart relationship are formed integrally in the inside surface of the guide member 219. On the other hand, a pair of rails 225 to be guided which extend substantially vertically in spaced-apart relationship are formed integrally on the outside surface in the width direction of each of the sliding members 221. As clearly shown in FIG. 12, the pair of rails 225 to be guided are inserted between the pair of guide rails 223. Thus, each of the sliding members 221 can slide substantially vertically while being guided by the pair of guide rails 223.

As shown in FIG. 12, a substantially horizontally extending rotating shaft 280 is rotatably mounted between the front sliding member 221 and the rear sliding member 221, and a rotating cam plate 286 and a gear 290 are fixed respectively to the front end portion and the rear end portion of the rotating shaft 280. A short rod 282 is rotatably mounted on each of the front sliding member 221 and the rear sliding member 221, and a rotating cam plate 288 and a gear 292 are fixed to the short rod 282. The shapes of the rotating cam plates 286 and 288 and the gears 290 and 292 and their relation may be substantially the same as the rotating cam plates 86 and 88 and the gears 90 and 92 in the first embodiment described above. Accordingly, a detailed description of these will be omitted.

Figure 13:
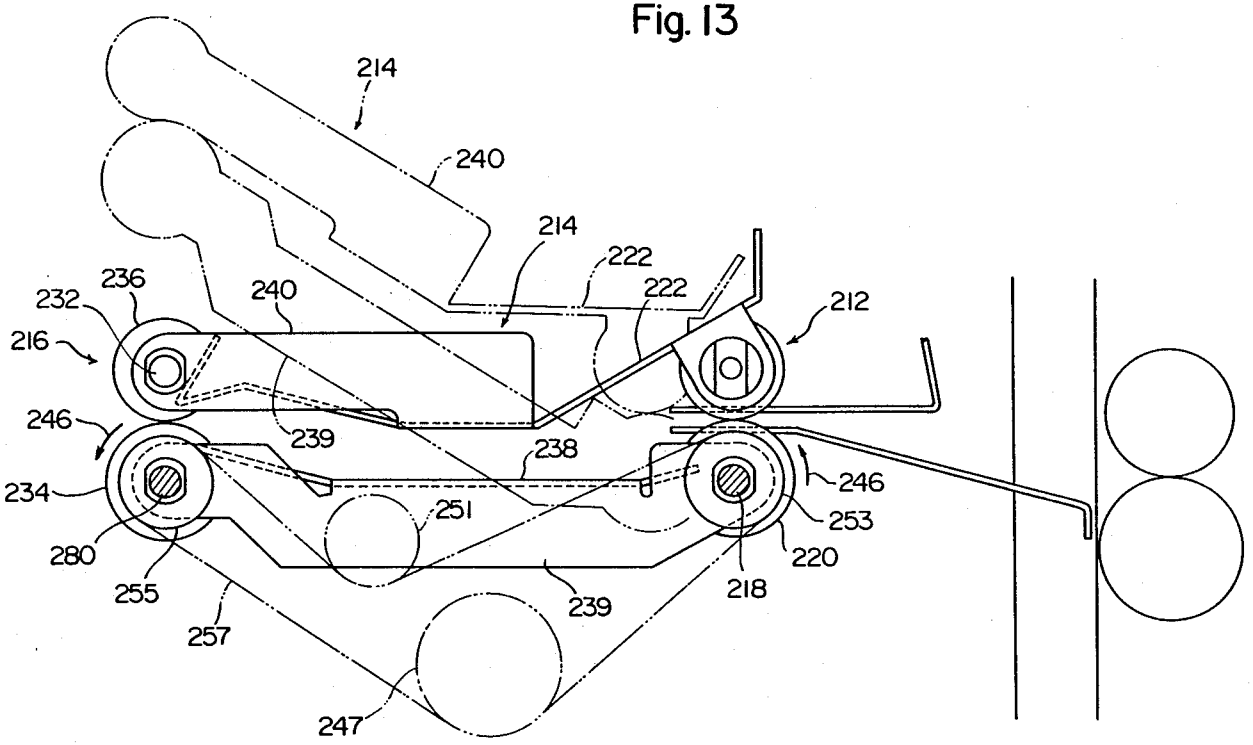
FIG. 13 is a sectional view showing part of the sorter of FIG. 9.

With reference to FIGS. 12 and 13, suspending pieces 239 extending downwardly are formed integrally in both sides in the width direction of a lower guide plate 38 in a second pair of guide plates 214. The upstream end portions of the suspending pieces 239 are pivotally linked to a rotating shaft 218 mounted between the side plates 206 and 208 in the stationary supporting frame 204. In the second embodiment, the rotating shaft 218 to which the lower roller 220 in the first conveying roller pair 212 is fixed is mounted between the side plates 206 and 208 in the stationary supporting frame 204 for free rotation and for free movement over a predetermined range in the left-right direction in FIG. 13. On the other hand, the downstream end portion of the suspending piece 239 is pivotably mounted on the rotating shaft 280 mounted on the sliding member 221. As shown in FIG. 12, a supporting member 241 extending downwardly is fixed to the front portion in the width direction of the lower guide plate 238 in the second guide plate pair 214, and a driving source 312 which may be electric motor is mounted on the supporting member 241. A toothed pulley 316 is fixed to the output shaft 314 of the driving source 312. On the other hand, a toothed pulley 310 is fixed to the front portion of the rotating shaft 280. A toothed belt 311 is wrapped over the toothed pulleys 310 and 316. The driving source 312, the toothed pulleys 310 and 316, the toothed belt 311 and the gears 290 and 292 constitute a driving means 318 in a transfer mechanism 278. When the driving source 312 is energized, the rotating cam plate 286 is rotated clockwise and the rotating cam plate 288, counterclockwise; or the rotating cam plate 286 is rotated counterclockwise and the rotating cam plate 288, clockwise.

As clearly shown in FIG. 12, a hollow cylindrical rotating shaft 230 capable of rotating independently of the rotating shaft 280 is mounted on the central part of the rotating shaft 280 mounted on the sliding member 221. A lower roller 234 in a second conveyor roller pair 216 is fixed to the rotating shaft 230. As shown in FIG. 10 in a simplified manner, a rotating shaft 232 extending substantially horizontally above the rotating shafts 280 and 230 is further mounted between the front sliding member 221 and the rear sliding member 221. An upper roller 236 of the second conveyor roller pair 16 is fixed to the rotating shaft 232. It will be appreciated by reference to FIG. 13 that the downstream end portions of the projecting pieces 240 formed in both sides of the downstream end portion of the upper guide plate 222 in the second guide plate pair 214 are pivotally linked to the rotating shaft 232. With reference to FIGS. 12 and 13, a downwardly extending supporting member 243 is fixed to the rear portion in the width direction of the lower guide plate 238 in the second guide plate pair 214. A driving source 244 which may be an electric motor is mounted on the supporting member 243. A pulley 247 is fixed to the output shaft 245 of the driving source 244. A short rod 249 is also rotatably mounted on the supporting member 243, and a pulley 251 is fixed to the short rod 249. Pulleys 253 and 255 are fixed to the rear end portions in the width direction of the rotating shafts 218 and 230, respectively. A belt 257 is wrapped over the pulleys 247, 251, 253 and 255. Thus, when the driving source 244 is energized, the first conveyor roller pair 212 and the second conveyor roller pair 216 are rotated in the direction shown by an arrow 246.

Figure 11:
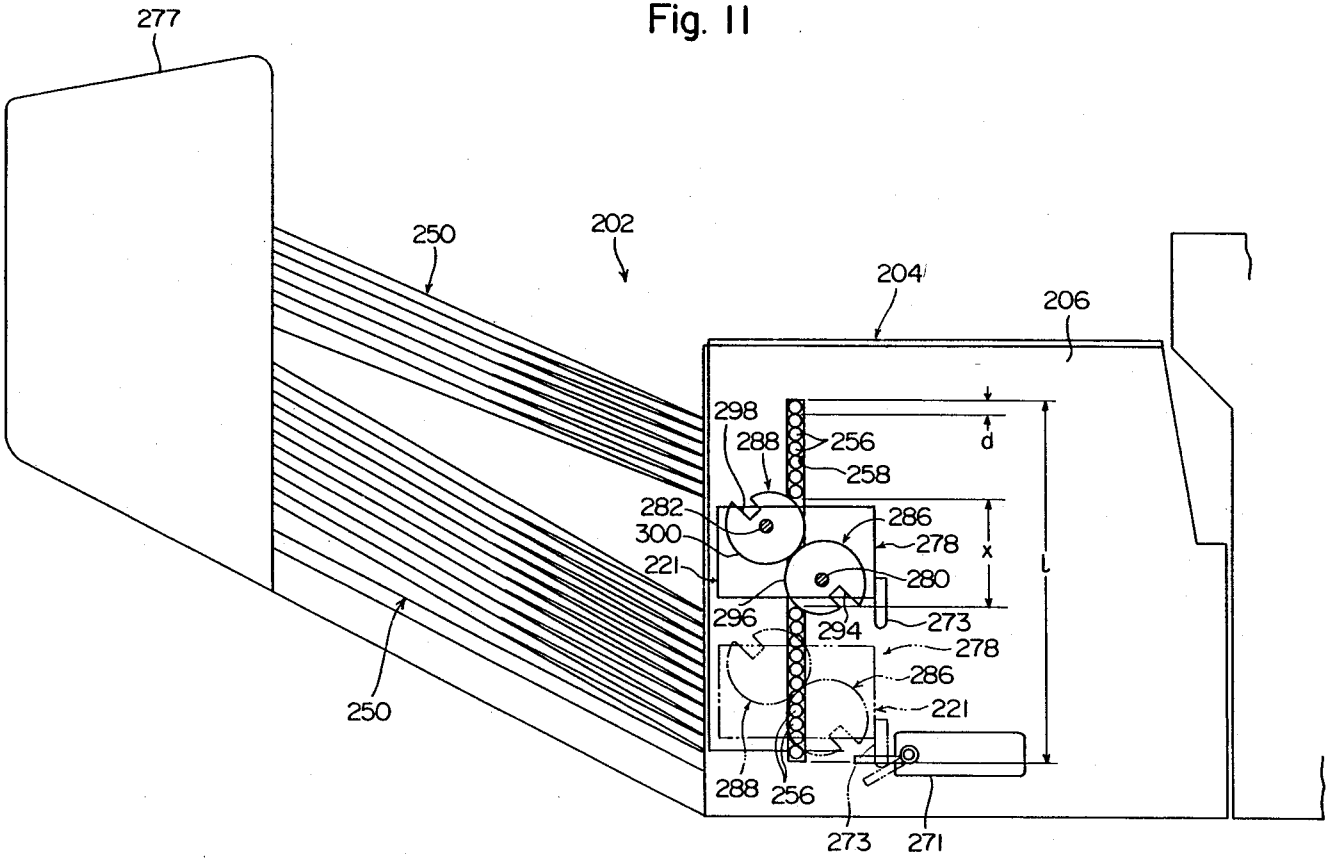
FIG. 11 is a simplified side view, partly broken away, of the sorter of FIG. 9.

As shown in FIGS. 9 to 11, trunnions 256 projecting outwardly in the width direction are fixed to both sides of the upstream end of each of the bin trays 250 in the second embodiment. On the other hand, a substantially vertically extending elongate slot 258 is formed in each of the side plates 206 and 208 in the stationary supporting frame 204. The trunnions 256 of the bin tray 250 project outwardly in the width direction through the slots 258. The trunnions 256 are stacked along the slots 258 in a substantially vertical direction.

But in the state shown in FIGS. 9 to 11, the upstream end of the 7th bin tray 250 and the upstream end of the 8th bin trays are vertically spaced from each other by the action of the transfer mechanism 278. Hence, the trunnions 256 of the seven bin trays 250 from the 1st to the 7th are successively contacted in the vertical direction, and the trunnions 256 of eleven bin trays 250 from the 8th to the 18th are also contacted successively in the vertical direction. But the trunnions 256 of the 7th bin tray 250 and the trunnions 256 of the 8th bin tray 250 are spaced from each other.

As clearly shown in FIG. 11, in the second embodiment, the length 1 of the slot 258 in the vertical direction is set at a value expressed by $1=18d+x$ where d is the diameter of each trunnion 256 and x is the distance between two trunnions 258 spaced from each other by the action of the transfer mechanism 278. Accordingly, in the illustrated state, the trunnion 256 of the 1st bin tray 250 abuts with or approaches the upper end of the slot 258, and the trunnions 256 of the 1st to 8th bin trays 250 cannot rise. The trunnion 256 of the 1st bin tray 250 from below (18th from above) abuts with the lower end of the slot 258, and therefore, the trunnions 256 of the 9th to 18th bin trays 250 cannot descend. If desired, in order to set the length 1 of the slot 258 precisely at a required value, the position of the upper end and/or the lower end of the slot 258 may be preset by a suitable position-adjustable means (not shown) such as the adjusting screw 70 (FIGS. 1 and 3) used in the first embodiment. If desired, it is further possible to dispose a spring means (not shown) acting on the trunnion 256 at the upper end and/or the lower end of the slot 258.

Otherwise, the second embodiment is substantially the same in structure as the first embodiment. To avoid duplication, therefore, a further description of the structure of the second embodiment will be omitted.

The operation and advantage of the second embodiment will now be described.

As shown in FIG. 10, the sorter 202 is used in combination with, for example, an electrostatic copying machine 320 as in the case of the first embodiment. A sheet (copying paper) discharged from the copying machine 320 by a discharge roller pair 322 is fed to the first conveyor roller pair 212 after passing between the guide plates of the first guide plate pair 211, and by the action of the first conveyor roller pair 212, is passed between the guide plates of the second guide plate pair 214 and fed to the second conveyor roller pair 216. Then, by the action of the second conveyor roller pair 216, it is discharged onto any of the bin trays 250. As shown in FIGS. 9 to 11, when the 7th bin tray 250 and the 8th bin tray 250 are vertically spaced from each other at their receiving ends to form a sheet receiving opening therebetween, the sheet conveyed by the action of the second conveyor roller pair 216 is discharged on to the 8th bin tray 250.

When in the state shown in FIGS. 9 to 11, the driving source 312 (FIG. 12) of the transfer mechanism 278 is energized for a predetermined period of time to rotate the rotating cam plate 286 clockwise and the rotating cam plate 288 counterclockwise through one turn, the 8th bin tray 250 and the 9th bin tray are spaced from each other vertically at their receiving ends, and the sheet conveyed by the action of the second conveyor roller pair 216 is in condition for discharge onto the 9th bin tray 250. More specifically, when the rotating cam plate 286 is rotated clockwise and the rotating cam plate 288 is rotated counterclockwise through one turn, the trunnion 256 of the 8th bin tray 250 which is in contact with the outer circumferential cam surface 296 of the rotating cam plate 286 advances into the trunnion receiving groove 294 of the rotating cam plate 286, and then gets out of the trunnion receiving groove 294 and advances into the trunnion receiving groove 298 of the rotating cam plate 288. Thereafter, it gets out of the trunnion receiving groove 298 and makes contact with the outer circumferential cam surface 300 of the rotating cam plate 288. As a result, this trunnion is elevated above the second conveyor roller pair 216 (see FIGS. 4-A and 4-H also). On the other hand, in the first embodiment, when the rotating cam plate 86 is rotated clockwise and the rotating cam plate 88 counterclockwise through one turn, all trunnions are gradually elevated. In the second embodiment, however, trunnions other than a specific trunnion (the trunnion 256 of the 8th bin tray) which is elevated at a relatively high speed by the action of the rotating cam plates 286 and 288 and the trunnion receiving grooves 294 and 298 cannot ascend. On the other hand, the sliding members 211 on which the rotating cam plates 286 and 288 are mounted are free to ascend and descend. Accordingly, assuming that the rotating cam plate 286 is rotated clockwise and the rotating cam plate 288 is rotated counterclockwise, the sliding members 221 mounted on the rotating cam plates 286 and 288 gradually descend as the radius of the outer circumferential cam surface 296 of the rotating cam plate 286 gradually decreases at that site of the rotating cam plate 286 with which the trunnion 256 of the 8th bin tray 250 makes contact until this trunnion advances into the trunnion receiving groove 294 and with which the trunnion 256 of the 9th bin tray 250 makes contact thereafter, and at the same time as the radius of the outer circumferential cam surface 300 of the rotating cam plate 288 gradually increases at that site of the rotating cam plate 288 with which the trunnion 250 of the 7th bin tray 250 makes contact until the trunnion 256 of the 8th bin tray 250 get out of the trunnion receiving groove 298 and with which the trunnion 256 of the 8th bin tray makes contact thereafter. The amount in which the sliding member 221 has descended while the rotating cam plate 286 is rotated clockwise and the rotating cam plate 288 is rotated counterclockwise through one turn corresponds to the diameter of one trunnion 25. As can be understood by reference to FIG. 13, when the sliding member 221 is lowered, the second conveyor roller pair 216 is also lowered because the latter is mounted on the former. As the second conveyor roller pair 216 descends, the upstream end portion of the second guide plate pair 214 is moved slightly in the right-left direction and at the same time pivoted counterclockwise in FIG. 13 with its upstream end portion (more specifically, the rotating shaft 218) as a center of turning. Thus, the sheet conveyed by the second conveyor roller pair 216 is in condition for discharge onto the 9th bin tray 250. It will be understood by reference to FIGS. 9 and 10 that while the trunnion 256 of the 8th bin tray 250 is elevated at a relatively high speed as described above, the supporting piece 274 provided on both sides of the downstream end portion of the 8th bin tray are caused to slide slightly downstream on the guide rails 279 of the guide members 277, and at the same time pivoted counterclockwise when viewed from ahead.

When the rotating cam plate 286 is rotated clockwise and the rotating cam plate 288 is rotated counterclockwise successively through one trun, the sheets conveyed by the action of the second conveyor roller pair 216 are in condition for discharge successively onto the 10th to 18th bin trays 250. For rotating the rotating cam plates 286 and 288, the driving source 312 may be energized, as in the first embodiment, after the laspe of a predetermined period of time from the time when the trailing end of the preceding sheet is detected by the detector 248 (FIG. 10). The detector 248 may be mounted on the lower guide plate 217 of the first guide plate pair 211. When the rotating cam plate 286 is rotated clockwise and the rotating cam plate 288 is rotated counterclockwise successively through one turn to create a condition in which the sheet is to be discharged onto the 1st bin tray 250 from below (the 18th from above) [in this condition, the trunnion 256 of the 1st bin tray 250 from below contacts the outer circumferential cam surface 296 of the rotating cam plate 286 and the trunnion 256 of the 2nd bin tray from below contacts the outer circumferential cam surface 300 of the rotating cam plate 288], the sliding members 221 are at their lowermost positions shown by a two-dot chain line in FIG. 11. As a result, the actuating piece 273 fixed to the sliding member 221 acts on the detecting arm of the detector 271 fixed to the side plate 206, and the detector 271 detects the fact that the sliding members 221 are at the lowermost positions.

On the other hand, when in the state shown in FIGS. 9 to 11, the driving source 312 (FIG. 12) of the transfer mechanism 278 is energized for a predetermined period of time to rotate the rotating cam plate 286 counterclockwise and the rotating cam plate 288 clockwise through one turn, the 6th bin tray 250 and the 7th bin tray 250 are spaced vertically from each other at their receiving ends and the sheet conveyed by the action of the second conveyor roller pair 216 is in condition for discharge onto the 7th bin tray 250. More specifically, when the rotating cam plate 286 is rotated counterclockwise and the rotating cam plate 288 is rotated clockwise through one turn, the trunnion 256 of the 7th bin tray 250 which has been in contact with the outer circumferential cam surface 300 of the rotating cam plate 288 advances into the trunnion receiving groove 298 of the rotating cam plate 288 and then gets out of it and advances into the trunnion receiving groove 294 of the rotating cam plate 286 and makes contact with the outer circumferential cam surface 296 of the rotating cam plate 286. As a result, this trunnion is lowered to below the second conveyor roller pair 216. While the rotating cam plate 286 is rotated counterclockwise and the rotating cam plate 288 is rotated clockwise through one turn, the sliding members 221 mounted on the rotating cam plates 286 and 288 are gradually elevated by an amount corresponding to the diameter of one trunnion 256. It will be undetstood by reference to FIG. 13 that when the sliding members 221 are elevated, the second conveyor roller pair 216 is also elevated because the latter is mounted on the former. As the second conveyor roller pair 216 is elevated, the upstream end portion of the second guide plate pair 214 is slightly moved in the left-right direction in FIG. 13 and at the same time, pivoted clockwise in FIG. 13 about the upstream end portion (more specifically, the rotating shaft 218) as a center of rotation. Thus, the sheet conveyed by the second conveyor roller pair 216 is in condition for discharge onto the 7th bin tray 250. It will be understood by reference to FIGS. 9 and 10 that while the trunnion 256 of the 7th bin tray 250 is lowered at a relatively high speed as described above, the supporting pieces 274 provided on both sides of the downstream end portion of the 7th bin tray 250 are caused to slide slightly upstream on the guide rails 279 of the guide member 277 and simultaneously pivoted clockwise when viewed from ahead.

When the rotating cam plate 286 is rotated counterclockwise and the rotating cam plate 288 is rotated clockwise successively through one turn, the sheets conveyed by the action of the second conveying roller pair 216 are in condition for discharge successively onto the 6th to 1st bin trays 250. When the sheet is in condition for discharge onto the 1st bin tray 250, trunnions 256 of all bin trays are positioned below the second conveyor roller pair 216 and the trunnion 256 of the 1st bin tray 250 makes contact with the outer circumferential cam surface 296 of the rotating cam plate 286.

In the second embodiment, when the rotating cam plates 286 and 288 are rotated through one turn in order to elevate a given trunnion 256 (for example, the trunnion 256 of the 8th bin tray) by a predetermined distance by the action of the rotating cam plates 286 and 288 and the trunnion receiving grooves 294 and 298 or to lower a given trunnion (for example, the trunnion 256 of the 7th bin tray 250) by a predetermined distance by the action of the rotating cam plates 286 and 288 and the trunnion receiving grooves 294 and 298, the sliding members 221 on which the rotating cam plates 286 and 288 are mounted are gradually lowered or elevated successively over the entire period of one-turn rotation of the rotating cam plates 286 and 288. Accordingly, the rising and lowering of the sliding members 221 are sufficiently smooth, and unlike the case of using the conventional Geneva rotating cam-type transfer mechanism, no excessive impact occurs and no abrupt lowering or elevation of the sliding members is caused. Hence, the transfer of the trunnions 256 (and the elevation or lowering of the sliding members 221) can be effected at sufficiently high speeds. The bin trays can function well over a long period of time without excessive friction, etc.

In the embodiment shown in FIGS. 9 to 13, the upward movement of the both sides of the downstream end portions of the bin trays 250 is restricted by the guide rails 279 formed in the inside surfaces of the guide members 277. Hence, when, for example, sheet jamming occurs between the 5th bin tray 250 and the 6th bin tray 250, the 5th bin tray and the 6th bin tray cannot be widely spaced from each other by lifting the downstream end portions of the 1st to 5th bin trays 250 and it is not always easy to remove the sheet.

FIGS. 14 to 17 shows a modified example of the method of supporting the downstream end portions of the bin trays.

Figure 16:
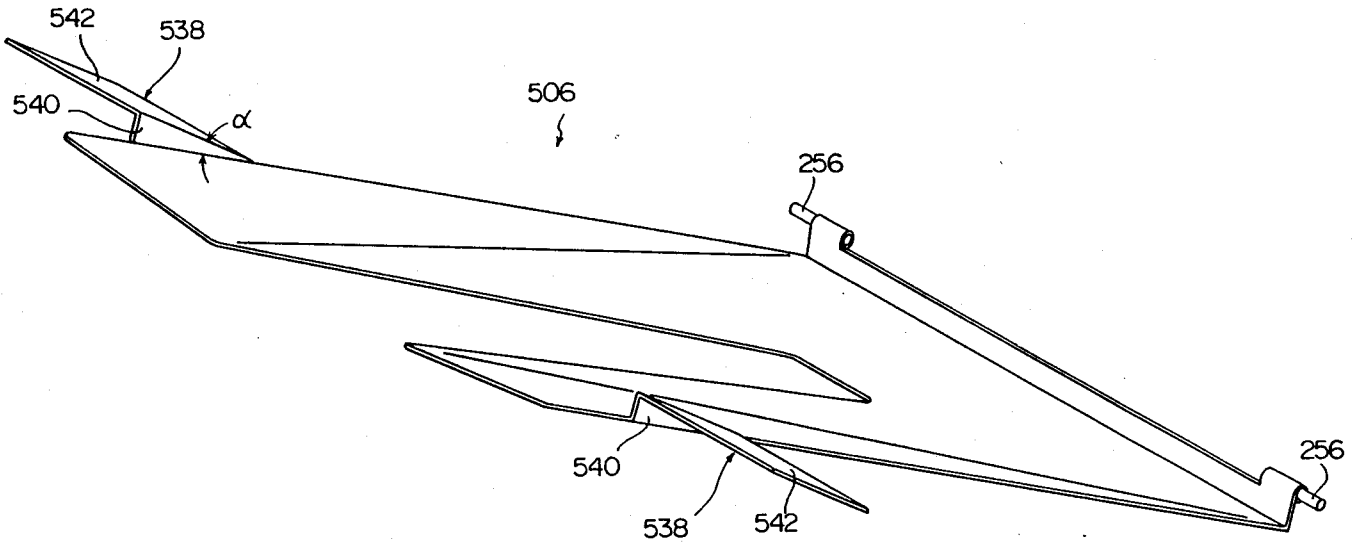
FIG. 16 is a perspective view showing the bin tray in the modified example of FIG. 14.

With reference to FIG. 16, supporting pieces 538 are formed integrally in both sides of the downstream end portion of a bin tray 506. Each supporting piece 538 has a rising portion 540 extending upwardly from the side edge of the downstream end portion of the bin tray 506 and a projecting portion 542 extending outwardly in the width direction from the upper end edge of the rising portion 540. The rising portion 540 is inclined upwardly and slightly outwardly in the width direction, as is seen from FIG. 17. As clearly shown in FIG. 16, the rising portion 540 is of a triangular shape whose upward projecting height progressively increases in the downstream direction, and the projecting portion 542 is rectangular. The projecting portion 542 is inclined upwardly in the downstream direction at an inclination angle $\alpha$ of about 20 to 30 degrees with respect to the side edge of the bin tray 506. It will be undertstood by reference to FIGS. 16 and 17 that the rising portions 540 of the supporting pieces 538 in all bin trays 506 are substantially the same. But the amounts of outward projection in the width direction in the projecting portions 542 of the supporting pieces 538 decrease stepwise from the upper bin trays 506 toward the lower bin trays 506. The amount of widthwise projection, $l_{max}$ in the 1st bin tray 506, and the amounts of widthwise projection, 1, of the projecting portions 542 in the lower bin trays 506 are decreased stepwise, and the amount of the widthwise projection in the nth bin tray, $l_n$, is set at $l_n = l_{max} - (n-1)c_1$. In the lowermost bin tray 504, the rising portion 540 is formed, but no projecting portion 542 is provided.

Figure 14:
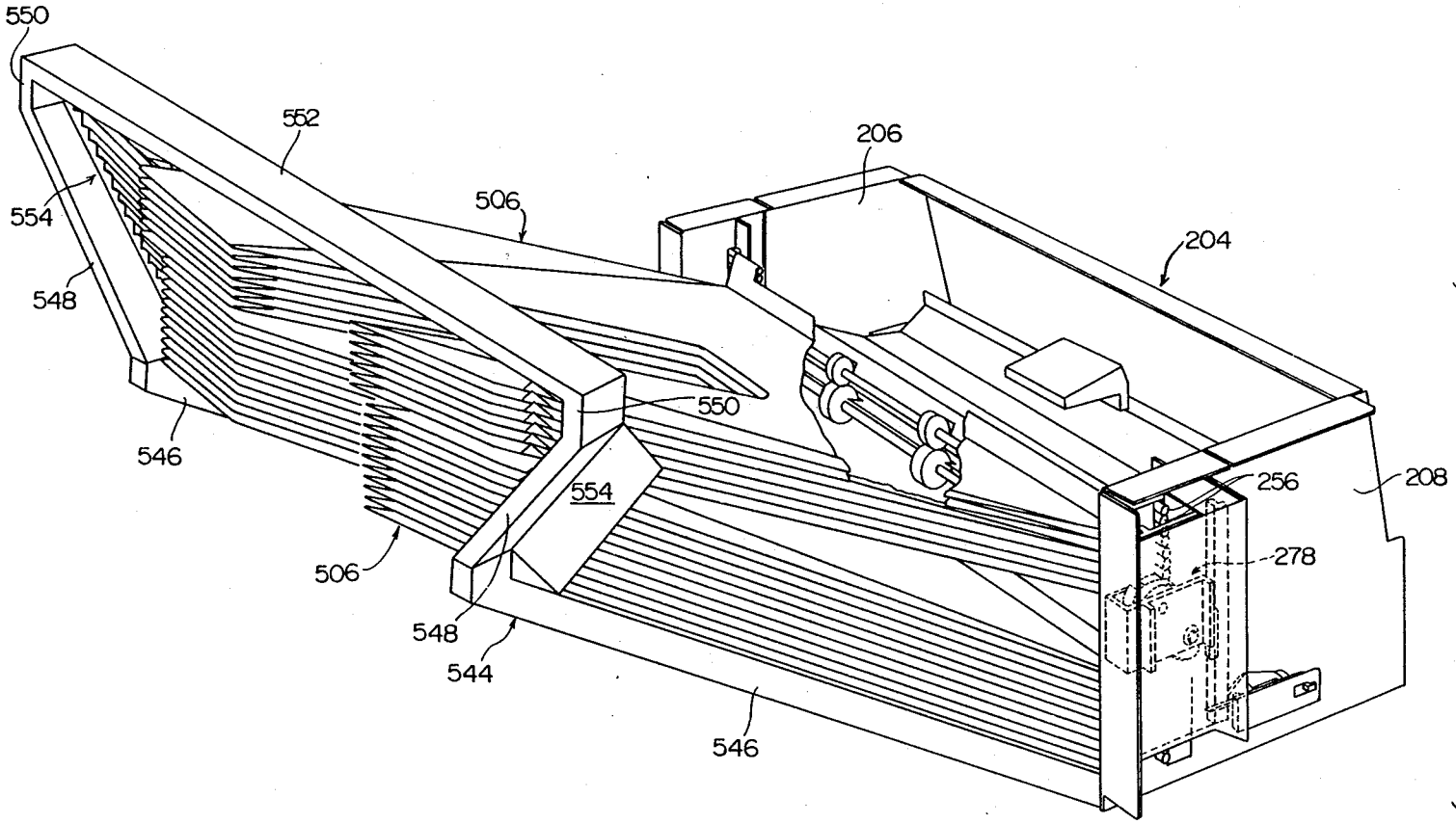
FIG. 14 is a perspective view showing a modified example of the method of supporting the downstream end portion of a bin tray.
Figure 15:
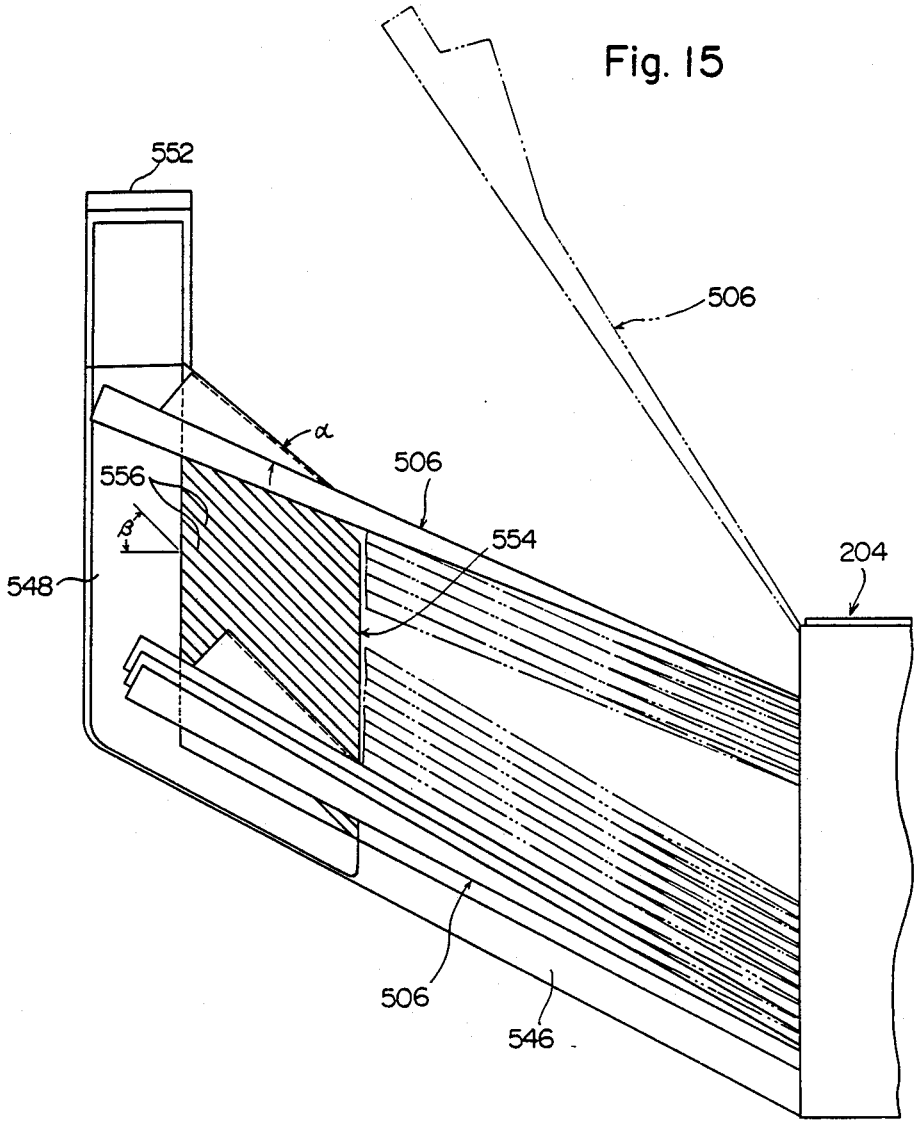
FIG. 15 is a simplified partial sectional view of the modified example shown in FIG. 14.

On the other hand, as shown in FIGS. 14 and 15, a supporting frame shown generally at 544 is annexed to the stationary supporting frame 204. The supporting frame 544 has extending portions 546 extending while being inclined upwardly from there upstream ends toward the downstream sides, inclined portions 548 extending upwardly from the downstream ends of the extending portions 546 while being inclined outwardly in the width direction, upstanding portions 550 extending upwardly substantially vertically from the inclined portions 548 and a horizontal portion 552 extending substantially horizontally between the upstanding portions 550. Guide members 554 are fixed to both sides of the downstream end portion of the supporting frames 544. If desired, the guide members 554 may be formed as an integral unit with the supporting frame 544.

Figure 17:
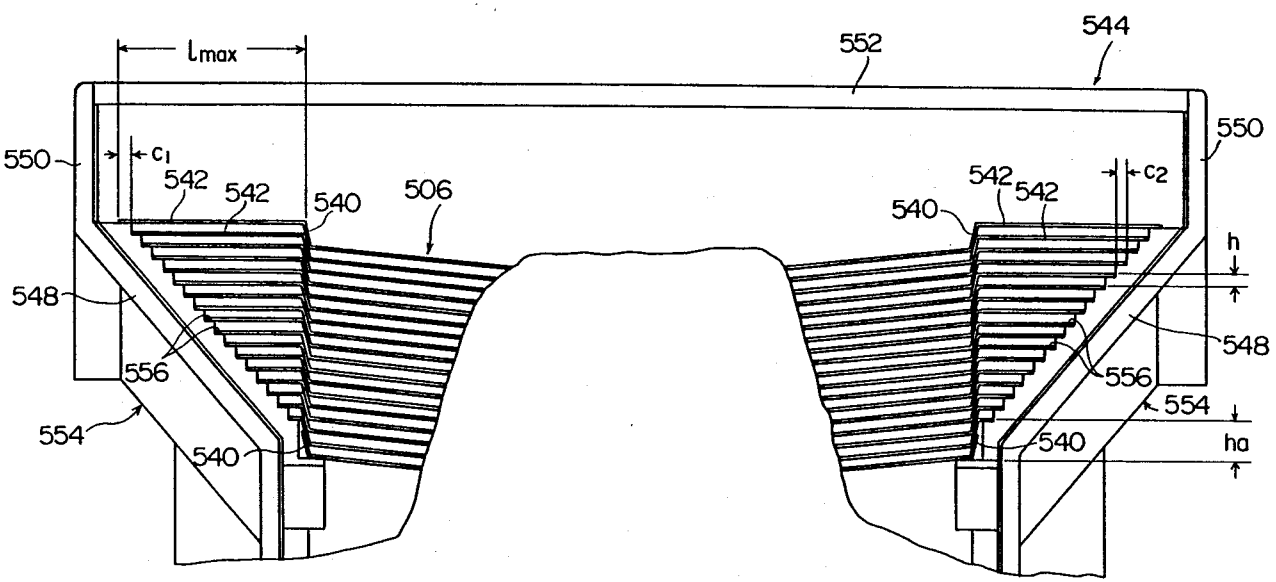
FIG. 17 is a partial side view of the modified example of FIG. 14.

It will be understood by reference to FIGS. 15 and 17 that each of the guide members 554 located opposite to each of the both sides of the downstream end portions of the bin trays 506 is nearly of a parallelogram in its side view (see FIG. 15), and in its end view seen from the downstream side, it extends upwardly along the inclined portion 548 of the supporting frame 544 while being inclined outwardly in the width direction. The inside surface of each of the guide members 554 is of a step-like form having a plurality of guiding surfaces displaced inwardly in the width direction stepwise from above to below, as clearly shown in FIG. 17. In the illustrated embodiment, the inside surface of each of the guiding member 554 has upwardly facing 18 guiding surfaces 556, in the 1st to the 17th guiding surfaces counted from above, the amount $c_2$ of widthwise displacement between adjacent guiding surfaces 556 and the vertical step difference h between them are substantially the same. The amount $c_2$ of widthwise displacement is prescribed at a substantially the same value as the aforesaid predetermined amount $c_1$ mentioned with regard to the projecting portion 542 of the supporting piece 538 in the bin tray 506. The step difference ha between the first guiding surface 556 counted from below and the second guiding surface counted from below is prescribed at a value larger than the other step difference h (this has to be with the fact that as stated hereinabove, no projecting portion 542 is formed in the first bin tray 506). It will be clearly understood by reference to FIG. 15 that conveniently, the guiding surfaces 556 formed in the inside surfaces of the guide members 554 are inclined upwardly toward the downstream at an angle of inclination $\beta$ of about 40 to 50 degrees.

It will also be undertstood by reference to FIGS. 15 and 17 that the downstream end portion of each of the bin trays 506 is supported by placing the projecting portion 542 of the supporting piece 538 on the corresponding guiding surface 556. Specifically, the projecting portion 542 of the 1st bin tray 506 is placed on the 1st guiding surface 556 in the guide member 554, and the projecting portion 542 of the nth bin tray 506 is placed on the nth guiding surface 556 in the guide member 554. In the illustrated embodiment, however, no projecting portion 542 is formed in the 1st bin tray from below, and as shown in FIG. 17, the downstream end portion of the 1st bin tray 506 from below is supported at a required position by placing its both side edge portions directly on the lowermost guiding surface 556 of the guide member 554.

When the upstream end of a given bin tray 506 is elevated or lowered by the action of the transfer mechanism 278, the projecting portion 542 of the given bin tray 506 slides downstream or upstream along the guiding surface 556 on which it is placed, and is simultaneously pivoted slightly with respect to this guiding surface 556 with reference to FIG. 15, while the trunnion 256 of the 8th bin tray 506 is elevated a predetermined distance by the action of the transfer mechanism 278 from the state shown in FIG. 15, the projecting portion 542 of the 8th bin tray 506 slides slightly downstream along the 8th guiding surface 556 in the guide member 554 and simultaneously pivots slightly counterclockwise. Conversely, while the trunnion 256 of the 7th bin tray 506 is lowered a predetermined distance by the action of the transfer mechanism 278 from the state shown in FIG. 15, the projecting portion 542 of the 7th bin tray 506 slides slightly upstream along the 7th guiding surface 556 (counted from above) of the guide member 554 and simultaneously pivots slightly clockwise.

In the modified example shown in FIGS. 14 to 17, the guiding surfaces 556 of the guide member 554 are displaced stepwise outwardly in the width direction from bottom to top. Accordingly, the elevation of the downstream end portion of a given bin tray 506 is not hampered by the guiding surface 556 of the bin tray 506 above it, and the downstream end portion of the given bin tray 506 can be elevated freely together with the downstream end portion of the bin tray 506 above it. Accordingly, in the event that sheet jamming occurs between the 7th bin tray 506 and the 8th bin tray 506, the sheet can be easily disposed of by manually elevating the lower ends portions of the 1st to 7th bin trays 506, pivoting these bin trays 506 about the trunnions 256 at their upstream ends, and thus spacing the 7th bin tray 506 widely from the 8th bin tray 506, as shown by two-dot chain lines in FIG. 15.

While the invention has been described in detail with reference to its specific embodiments shown in the accompanying drawings, it should be understood that the invention is not limited to these embodiments, but various changes and modifications are possible without departing from the scope of the invention described and claimed herein.

We claim:

1. A sorter provided with a plurality of vertically arranged bin trays, the bin trays respectively having a widthwise projecting trunnion in at least one side thereof, the trunnions being vertically stacked and being movable in the stacking direction along a predetermined moving passage, and a transfer mechanism for elevating and lowering the trunnions successively one by one through the predetermined transfer passage and spacing adjacent bin trays from each other vertically at their sheet receiving ends to form a sheet receiving opening between them; wherein the transfer mechanism includes a pair of cooperating rotating cam plates and a rotating means, each of the rotating cam plates has at least one trunnion receiving groove extending radially and being open at its radially outside end and an outer circumferential cam surface extending continuously in the circumferential direction excepting a site corresponding to the trunnion receiving groove, and the outer circumferential cam surface is a convoluted surface whose radius increases progressively in a given rotating direction, the pair of rotating cam plates are arranged such that their rotating central axes are positioned on both sides of the predetermined moving passage, a straight line connecting the rotating central axes crosses the predetermined moving passage obliquely, and that they move toward and away from each other in a predetermined rotating angular relation at a part at which the straight line connecting their rotating central axes crosses the predetermined moving passage, and the rotating means rotates the pair of rotating cam plates synchronously in opposite directions to each other.

2. The sorter of claim 1 wherein the outer circumferential cam surface of each of the rotating cam plates is an Archimedian convoluted surface whose ratio of the rotating angle to the increase of the radius is constant.

3. The sorter of claim 1 or 2 wherein the cross-sectional shape of each of the trunnions is circular, and the difference between the maximum radius and the minimum radius in said outer circumferential cam surface of each rotating cam plate corresponds to the diameter of one trunnion.

4. A transfer mechanism for a plurality of trunnions stacked and being movable in the stacking direction along a predetermined moving passage; wherein the transfer mechanism includes a pair of cooperating rotating cam plates and a rotating means, each of the rotating cam plates has at least one trunnion receiving groove extending radially and being open at its radially outside end and an outer circumferential cam surface extending continuously in the circumferential direction excepting a site corresponding to the trunnion receiving groove, and the outer circumferential cam surface is a convoluted surface whose radius increases progressively in a given rotating direction, the pair of rotating cam plates are arranged such that their rotating central axes are positioned on both sides of the predetermined moving passage, a straight line connecting the rotating central axes crosses the predetermined moving passage obliquely, and that they move toward and away from each other in a predetermined rotating angular relation at a part at which the straight line connecting their rotating central axes crosses the predetermined moving passage, and the rotating means rotates the pair of rotating cam plates synchronously in opposite directions to each other.

5. The sorter of claim 4 wherein the outer circumferential cam surface of each of the rotating cam plates is an Archimedian convoluted surface whose ratio of the rotating angle to the increase of the radius is constant.

6. The sorter of claim 4 or 5 wherein the cross-sectional shape of each of the trunnions is circular, and the difference between the maximum radius and the minimum radius in said outer circumferential cam surface of each rotating cam plate corresponds to the diameter of one trunnion.

* * * * *